US009372040B2

(12) United States Patent
Zheng

(10) Patent No.: US 9,372,040 B2
(45) **Date of Patent: *Jun. 21, 2016**

(54) MAGAZINE SHELL OF A UNIVERSAL MAGAZINE OF MULTIPLE CALIBER COMPATIBILITY FOR FIREARMS

(71) Applicant: Jing Zheng, El Paso, TX (US)

(72) Inventor: Jing Zheng, El Paso, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/474,271

(22) Filed: Sep. 1, 2014

(65) Prior Publication Data

US 2014/0366417 A1 Dec. 18, 2014

Related U.S. Application Data

(63) Continuation-in-part of application No. 13/731,089, filed on Dec. 30, 2012, now Pat. No. 8,850,732.

(51) Int. Cl.
*F41A 9/70* (2006.01)
*F41A 9/71* (2006.01)

(52) U.S. Cl.
CPC ..... *F41A 9/71* (2013.01)

(58) Field of Classification Search
CPC ..... F41A 9/70; F41A 9/71
USPC ..... 42/49.01, 49.02, 50
See application file for complete search history.

(56) References Cited

U.S. PATENT DOCUMENTS

| | | | | | |
|---|---|---|---|---|---|
| 2,735,206 | A * | 2/1956 | Butler et al. | 42/18 |
| 3,180,046 | A * | 4/1965 | Menneking et al. | 42/50 |
| 4,408,409 | A * | 10/1983 | Arias L. | 42/50 |
| 4,776,122 | A * | 10/1988 | Dieringer et al. | 42/50 |
| 4,888,899 | A * | 12/1989 | Chesnut et al. | 42/50 |
| 8,028,455 | B1 * | 10/2011 | Battaglia | 42/49.02 |
| 8,850,732 | B2 * | 10/2014 | Zheng | 42/50 |
| 2010/0313458 | A1 * | 12/2010 | Aalto | 42/50 |
| 2012/0131831 | A1 * | 5/2012 | Sullivan et al. | 42/50 |
| 2013/0185974 | A1 * | 7/2013 | Colmano et al. | 42/49.1 |

* cited by examiner

*Primary Examiner* — Bret Hayes
(74) *Attorney, Agent, or Firm* — Han IP Corporation; Andy M. Han

(57) ABSTRACT

Various embodiments of a magazine for a firearm are described. In one aspect, a magazine for a firearm may include a magazine shell having a first end, a second end opposite the first end, and a plurality of sidewalls between the first end and the second end. The first end may have an opening and may be configured to attach to the firearm. The second end may include a bottom plate. At least a first primary sidewall of the sidewalls may include a deformable concave area that caves inward with respect to the magazine shell such that the concave area bulges outward with respect to the magazine shell to accommodate one or more ammunition cartridges with of a first caliber and that the concave area does not bulge outward to accommodate one or more ammunition cartridges of a second caliber smaller than the first caliber.

16 Claims, 17 Drawing Sheets

MAGAZINE SHELL OF A UNIVERSAL MAGAZINE OF MULTIPLE CALIBER COMPATIBILITY FOR FIREARMS

CROSS-REFERENCE TO RELATED APPLICATIONS

This is a continuation-in-part (CIP) of U.S. patent application Ser. No. 13/731,089, filed on Dec. 30, 2012 and claiming the priority benefit of U.S. Patent Application No. 61/582,205, which was filed on Dec. 30, 2011. The entirety of the above-identified patent applications is hereby incorporated by reference.

TECHNICAL FIELD

The present disclosure generally relates to firearms. More specifically, the present disclosure relates to a magazine for firearms.

BACKGROUND

In the context of firearms, a magazine is an ammunition storage and feeding device within or attached to a repeating firearm. The magazine functions by moving the ammunition cartridges stored in the magazine into a position where the cartridges are loaded into the chamber of the firearm. In order for fresh rounds of ammunition to be reloaded to the firearm reliably, each ammunition cartridge needs to be in a specific angle and position aligned with the firearm barrel so that it can be rammed into the barrel by the firearm action devices, e.g., the rifle bolt or handgun slides. To ensure such feeding process proceeds smoothly, the firearm magazine is designed to provide each round of ammunition with full support within the magazine. FIG. 3 illustrates a prior art firearm magazine 10. As shown in FIG. 3, a spring inside the magazine pushes the ammunition against the magazine lip 11 securely so that the ammunition will align axially with the barrel at the designed angle and position.

For the ease of ejection after firing, ammunition cartridges, especially rifle cartridges, have various tapering design on the casing. Due to the material used for the casing, some ammunition cartridges have larger tapering angle than others. There is one dubbed as 7.62×39, also known as M43 or 762 Russian, which has one of the largest case tapering. Another popular caliber, which is dubbed as 223 Remington, has one of the smallest case tapering. FIG. 4 illustrates an M43 ammunition 20. FIG. 5 illustrates a 223 Remington ammunition 30. As shown in FIGS. 4 and 5, the casing 22 of the M43 ammunition 20 and the casing 32 of the 223 Remington ammunition 30 have different tapering angles. FIG. 6 illustrates how the M43 ammunition cartridges are stacked inside a magazine in order to maintain full support of each ammunition cartridge. FIG. 7 illustrates how the 223 Remington ammunition cartridges are stacked inside a magazine in order to maintain full support of each ammunition cartridge. As shown in FIGS. 6 and 7, given the tapering angle of the casing, the stack of M43 ammunition cartridges and the stack of 223 Remington ammunition cartridges appear to have a "bent" shape although the stack of M43 ammunition cartridges has a more pronounced "bent" shape given the relatively larger tapering angle of the M43 ammunition casing. Accordingly, the design of the magazine may need to adopt the "bent" shape. FIG. 8 illustrates an AK style magazine that is a banana shaped magazine. There is, however, one disadvantage associated with the kind magazine as that shown in FIG. 8. As the whole magazine has a banana shape, it has to be mounted onto a firearm with a rotational action. As a result, it is not easy to drop such a magazine by its own weight when the magazine is empty.

On the contrary, rifles such as AR15 use a STANAG magazine that utilizes a straight-bent-straight design so that the end that has the feeding lip has a straight portion and can be inserted into the rifle's straight magazine wall. FIG. 9 illustrates such a STANAG magazine. When the magazine catch is released, the magazine can be dropped out of the rifle by its own weight. This allows the firearm operator to insert a loaded magazine back into the firearm with relatively less time compared to the case with the AK47 style magazine. Although the time difference may be seconds or fractions of a second, such time difference could mean a difference of life and death in the battle field.

However, such straight-bent-straight design has problems. One problem is that ammunition cartridges of different calibers have different rim diameters (the diameter of the casing near the bottom area, where the diameter is the biggest, which is called "rim").

To stack the ammunition cartridges efficiently inside of the magazine, the ammo should be staged in the way shown in FIG. 10. This way, the ammunition cartridge is supported by the interior of the magazine groove, and by each other ammunition cartridge, tightly. However, for ammunition cartridges of other calibers having a smaller rim diameter, the minimum distance between the groove interior may not be able to support each cartridge and the support between each cartridge is no longer certain. FIG. 11 shows one of the possible positional relationships between each cartridge. Compared to what is shown in FIG. 10, the relative position of ammunition cartridges between each other inside the magazine wall can be altered. FIG. 12 shows another possibility of ammunition cartridge stacked inside of the magazine, which is a non-stable scenario. Movement of the magazine during the usage will likely shift the ammunition inside to other configurations. Such shifting may cause jam of the ammunition, and/or other malfunctions, during firing. For example, when ammunition cartridges with a smaller rim diameter are stacked in the magazine that is suitable for large rim diameters, as shown in FIG. 11, the ammunition cartridges may jump out of the magazine lip by themselves, due to the uncertain forces acted on each individual ammunition cartridge. This not only affects the reliable storage function of the magazine, it will also introduce jam that is hard to be cleared.

As AR15 rifles are among the most popular rifles in the civilian market, ammunition cartridges of different calibers are available for the AR15 rifles. Consequently, ammunition cartridges with casings of various tapering angles and rim diameters have to cope with the straight magazine wall design of the AR15 rifle.

SUMMARY

The present disclosure is directed to a magazine shell of a universal magazine with multiple caliber compatibility and straight magazine wall.

According to one aspect, a magazine for a firearm may comprise a magazine shell, a follower (or follower assembly), a bottom plate, and a main magazine spring. The magazine shell may include a first end, a second end opposite the first end, and sidewalls between the first end and the second end. The first end may have an opening and configured to attach to the firearm. The second end may be configured to hold or include a bottom plate. The main magazine spring may include a first end and a second end opposite the first end. The second end of the main magazine spring may be coupled to the bottom plate of the second end of the magazine shell. The magazine may comprise either a follower or a follower assembly, disposed inside the magazine shell, which may be movable generally along a longitudinal axis of the magazine shell.

In at least one embodiment, the magazine shell may include at least one reinforcement groove having a plurality of sections thereof. A cross-sectional diameter of a first section of the plurality of sections of the at least one reinforcement groove may be different from a cross-sectional diameter of a second section of the plurality of sections of the at least one reinforcement groove.

In at least one embodiment, the magazine shell may include a first reinforcement groove on a first primary side of the magazine shell. The magazine shell may further include a second reinforcement groove on a second primary side of the magazine shell opposite to the first primary side. Variations in the cross-sectional diameter of each of the first and the second reinforcement grooves may render a distance between an inner surface of the first primary side and an inner surface of the second primary side to generally decrease as viewed in a direction from the second end toward the first end of the magazine shell.

The universal magazine may further comprise a deformable magazine sidewall spring. The deformable magazine sidewall spring may be received in the magazine shell and fitted along an internal surface of the magazine shell. The deformable magazine sidewall spring may provide side support to one or more ammunition cartridges when the one or more ammunition cartridges are held in the magazine shell and in contact with the deformable magazine sidewall spring by deforming and exerting a third force on the one or more ammunition cartridges in directions generally perpendicular to the sidewalls of the magazine shell.

In at least one embodiment, the deformable magazine sidewall spring may comprise a thin sheet metal.

In at least one embodiment, the deformable magazine sidewall spring may have an outer surface contoured to match an inner surface of the sidewalls of the magazine shell. The sidewalls of the magazine shell may include one or more reinforcement grooves. The deformable magazine sidewall spring may include one or more grooves corresponding to the one or more reinforcement grooves of the magazine shell. The one or more grooves of the deformable magazine sidewall spring may provide side support to one or more ammunition cartridges when the one or more ammunition cartridges are held in the magazine shell.

In at least one embodiment, the deformable magazine sidewall spring may include a protrusion that extends outside the magazine shell and contacts an external surface of the magazine shell when the deformable magazine sidewall spring is received in the magazine shell. The protrusion may reinforce sealing between the deformable magazine sidewall spring and the magazine shell.

In at least one embodiment, the deformable magazine sidewall spring may include a protrusion that extends into a feeding lip of the magazine shell and forms a bump a ridgeline of which is generally parallel with a ridgeline of the feeding lip of the magazine shell. The bump may provide guidance support to one or more ammunition cartridges of different calibers when the one or more ammunition cartridges are pushed out of the magazine shell and into a firing chamber of the firearm by a bolt of the firearm.

According to another aspect, a magazine for a firearm may comprise a magazine shell, a bottom plate, a main magazine spring, a follower or follower assembly, and a deformable magazine sidewall spring. The magazine shell may have a first end, a second end opposite the first end, and sidewalls between the first end and the second end. The first end may have an opening and configured to attach to the firearm. The second end may be configured to hold or include a bottom plate. The main magazine spring may include a first end and a second end opposite the first end. The second end of the main magazine spring may be coupled to the bottom plate of the second end of the magazine shell. The deformable magazine sidewall spring may be received in the magazine shell and fitted along an internal surface of the magazine shell. The deformable magazine sidewall spring may provide side support to one or more ammunition cartridges when the one or more ammunition cartridges are held in the magazine shell and in contact with the deformable magazine sidewall spring by deforming and exerting a third force on the one or more ammunition cartridges in directions generally perpendicular to the sidewalls of the magazine shell. Such third force may vary depending on ammunition cartridges with different rim diameters. The magazine may comprise a follower or a follower assembly, disposed inside the magazine shell, which may be movable generally along a longitudinal axis of the magazine shell.

In at least one embodiment, the deformable magazine sidewall spring may comprise a thin sheet metal.

In at least one embodiment, the deformable magazine sidewall spring may have an outer surface contoured to match an inner surface of the sidewalls of the magazine shell.

In at least one embodiment, at least a first sidewall of the sidewalls of the magazine shell may include at least one reinforcement groove having a plurality of sections thereof. A cross-sectional diameter of a first section of the plurality of sections of the at least one reinforcement groove may be different from a cross-sectional diameter of a second section of the plurality of sections of the at least one reinforcement groove.

In at least one embodiment, the magazine shell may include a first reinforcement groove on a first primary side of the magazine shell. The magazine shell may further include a second reinforcement groove on a second primary side of the magazine shell opposite to the first primary side. Variations in the cross-sectional diameter of each of the first and the second reinforcement grooves may render a distance between an inner surface of the first primary side and an inner surface of the second primary side to generally decrease as viewed in a direction from the second end toward the first end of the magazine shell.

In at least one embodiment, the deformable magazine sidewall spring may include at least one groove corresponding to the at least one reinforcement groove of the magazine shell. The at least one groove of the deformable magazine sidewall spring may provide side support to one or more ammunition cartridges when the one or more ammunition cartridges are held in the magazine shell.

In at least one embodiment, the deformable magazine sidewall spring may include a protrusion that extends outside the magazine shell and contacts an external surface of the magazine shell when the deformable magazine sidewall spring is received in the magazine shell. The protrusion may reinforce sealing between the deformable magazine sidewall spring and the magazine shell.

In at least one embodiment, the deformable magazine sidewall spring may include a protrusion that extends into a feeding lip of the magazine shell and forms a bump a ridgeline of which is generally parallel with a ridgeline of the feeding lip of the magazine shell. The bump may provide guidance support to one or more ammunition cartridges of different calibers when the one or more ammunition cartridges are pushed out of the magazine shell and into a firing chamber of the firearm by a bolt of the firearm.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Overview

Figure 1:
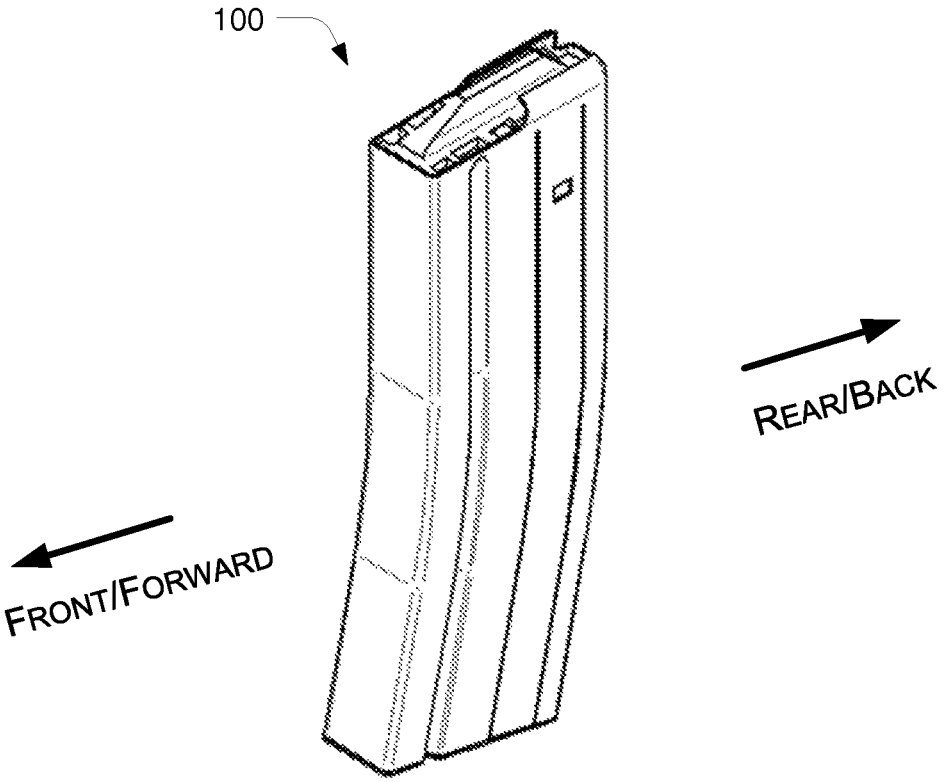
FIG. 1 is an assembly view of a universal magazine in accordance with an embodiment of the present disclosure.

Various embodiments of the present disclosure relate to a universal magazine shell for firearms, such as rifles, that have straight magazine wall. The universal magazine can accommodate ammunition cartridges of various calibers. More specifically, the universal magazine can reliably feed ammunition cartridges into a rifle chamber regardless of the caliber of the ammunition cartridges as long as the ammunition cartridges can fit in the universal magazine. The universal magazine may include a universal magazine shell and a self-adjusting deformable magazine sidewall spring. Alternatively, the universal magazine may include a universal magazine shell without the self-adjusting deformable magazine sidewall spring.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

Example Universal Magazine

Figure 2A:
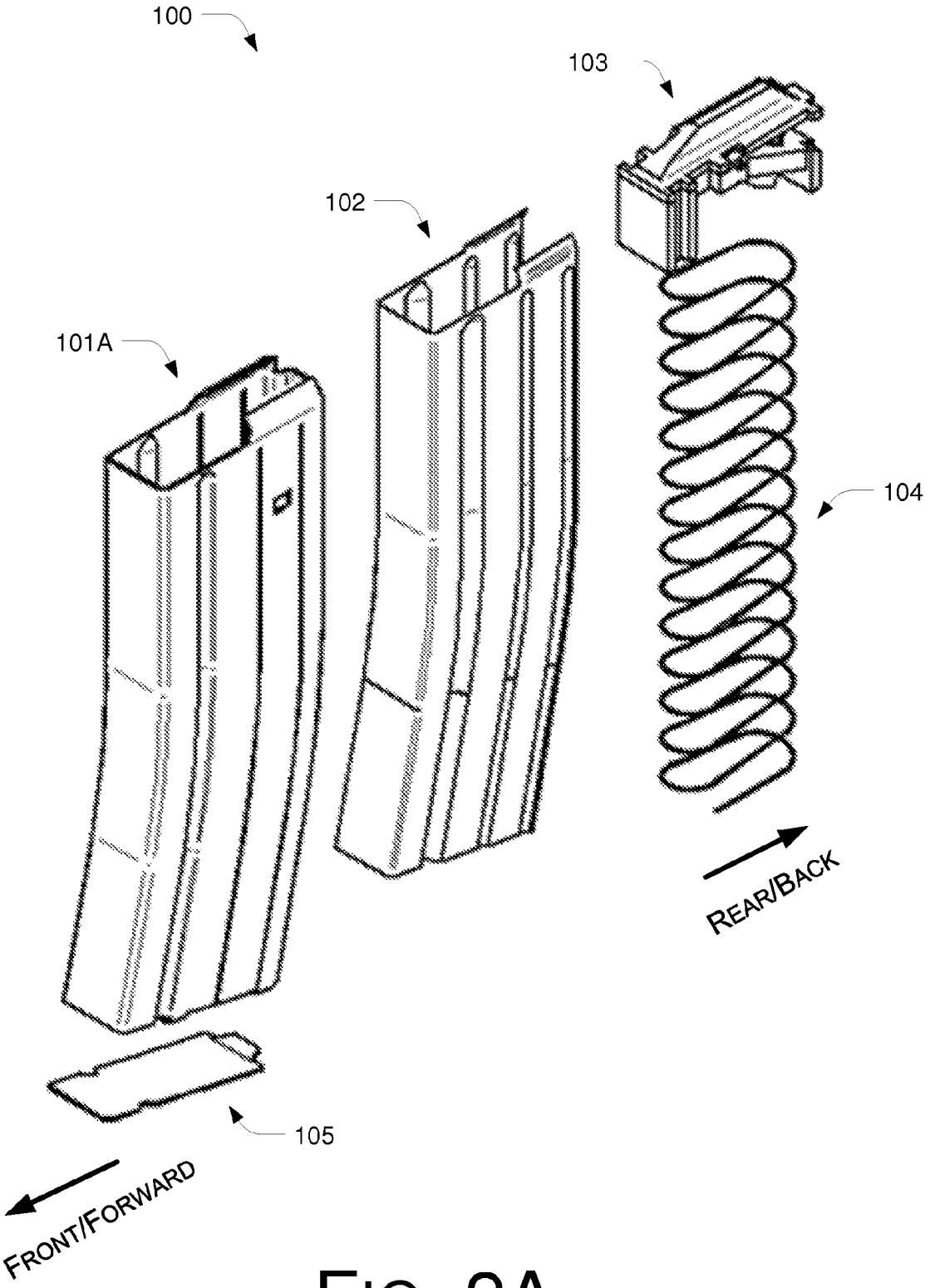
FIG. 2A is an exploded view of the universal magazine of FIG. 1 in accordance with an embodiment of the present disclosure.
Figure 2B:
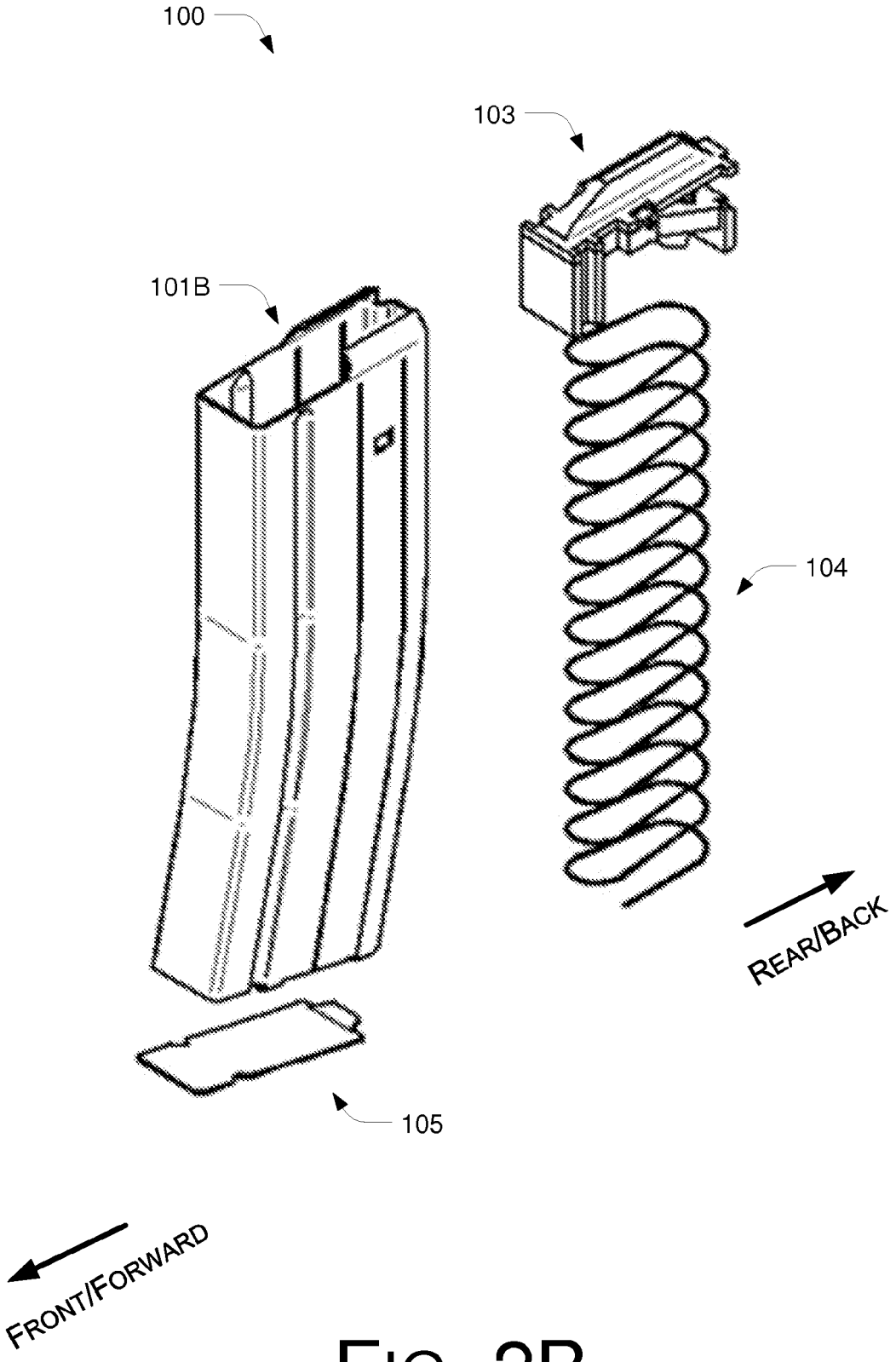
FIG. 2B is an exploded view of the universal magazine of FIG. 1 in accordance with another embodiment of the present disclosure.

FIG. 1 and FIGS. 2A, 2B illustrate a universal magazine 100 for a firearm in accordance with an embodiment of the present disclosure. Referring to FIG. 2B, the universal magazine 100 comprises a magazine shell 101B, a main magazine spring 104, and a tilt-able self-levering follower assembly 103. Optionally, referring to FIG. 2A, the universal magazine 100 may comprise a magazine shell 101A, the main magazine spring 104, the tilt-able self-levering follower assembly 103, and a self-adjusting deformable magazine sidewall spring 102. The design of the universal magazine 100 is aimed to reliably feed ammunition cartridges of various calibers, even with large tapering angle on the casing, to a firearm, such as the AR15 rifle for example, that has a straight magazine wall design. Those skilled in the art would appreciate that, although examples given in the present disclosure may refer to the AR15 rifle, embodiments described herein and variations thereof may be applied to other firearms having a straight magazine wall design. In other words, the scope of the present disclosure is not limited to applications in the AR15 rifle, and extends to other suitable firearms as well.

Detailed description of various embodiments of the tiltable self-levering follower assembly 103 is provided in copending U.S. application Ser. No. 13/731,037 and thus will not be provided herein in the interest of brevity.

For simplicity, both the magazine shell 101A and 101B are together referred to as the magazine shell 101 when common features are described. The magazine shell 101 includes a first end, a second end opposite the first end, and sidewalls between the first end and the second end. For example, the first end of the magazine shell 101 may be the end that is on the upper end of the magazine shell 101, as shown in FIGS. 1, 2A and 2B; and the second end of the magazine shell 101 may be the distal end that is on the lower end of the magazine shell 101, as shown in FIGS. 1, 2A and 2B. The first end of the magazine shell 101 has an opening and configured to attach to the firearm. Ammunition cartridges held in the universal magazine 100 are fed into the chamber of the firearm through the opening of the first end of the magazine shell 101. The second end of the magazine shell 101 may have an opening, and may include a bottom plate 105, as shown in FIGS. 2A and 2B, that encloses the universal magazine 100 on the second end of the magazine shell 101. In at least one implementation, the magazine shell 101 is of a straight-bent-straight design similar to that of a STANAG magazine. The magazine shell 101A shown in FIG. 2A may be similar to those of conventional design, while the magazine shell 101B shown in FIG. 2B is a new design in accordance with the present disclosure.

The main magazine spring 104 has a first end and a second end opposite the first end. When assembled, the second end of the main magazine spring 104 is coupled to the bottom plate 105 of the second end of the magazine shell 101, such as to an inner surface of the bottom plate 105 (or a hook thereon) for example. The main magazine spring 104 may be a compression spring, as shown in FIGS. 2A and 2B.

Example Embodiments of Magazine Shell

Figure 13:
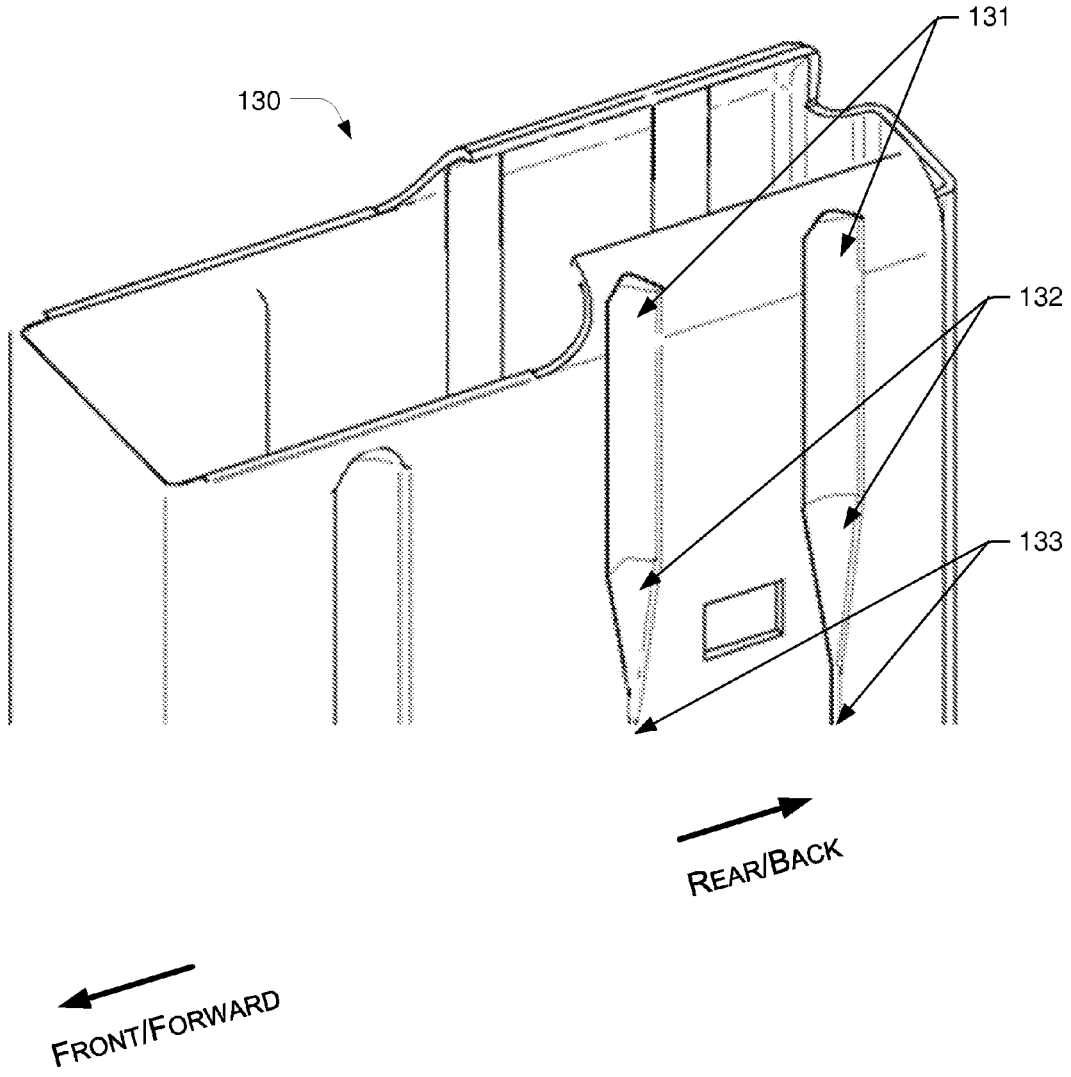
FIG. 13 is a perspective view of a magazine shell design without a magazine sidewall spring in accordance with an embodiment of the present disclosure.

FIG. 13 illustrates a magazine shell 130 without a magazine sidewall spring in accordance with an embodiment of the present disclosure. As shown in FIG. 2B, the universal magazine 100 may comprise a new magazine shell 101B that does not require a magazine sidewall spring, as with the magazine sidewall spring 102 shown in FIG. 2A. The magazine shell 130 shown in FIG. 13 may be implemented as magazine shell 101B in the universal magazine 100 of FIG. 2B.

Figure 3:
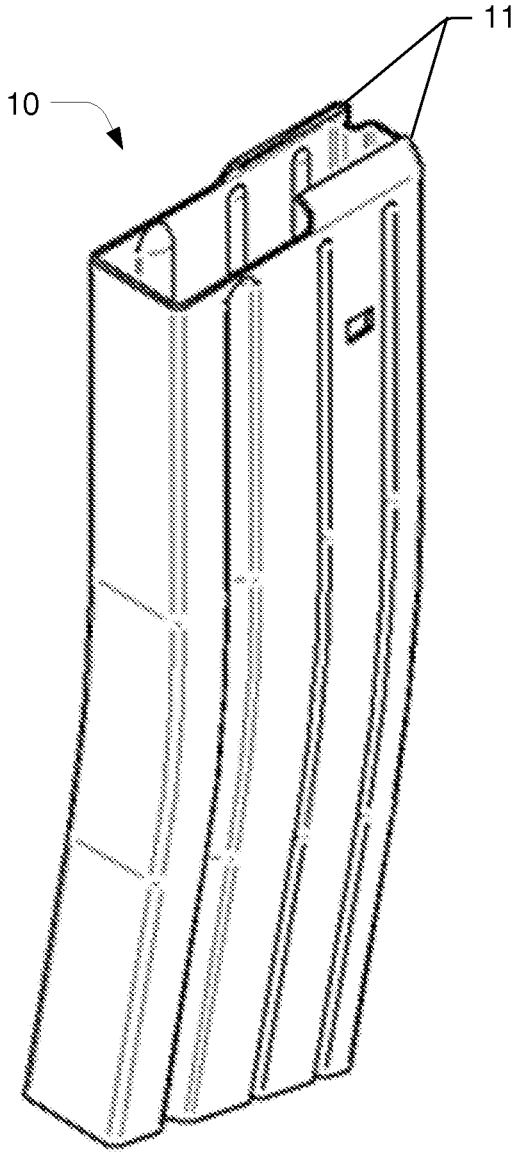
FIG. 3 (PRIOR ART)
FIG. 3 is a perspective view of a STANAG standard magazine.
Figure 4:
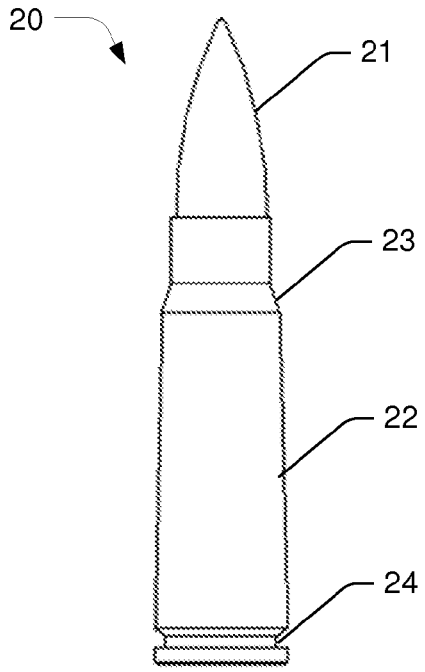
FIG. 4 (PRIOR ART)
FIG. 4 is a side view of an M43 ammunition cartridge.
Figure 5:
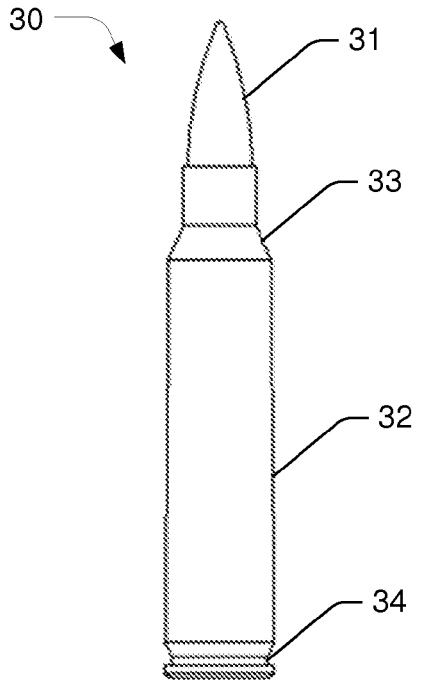
FIG. 5 (PRIOR ART)
FIG. 5 is a side view of a 223 Remington ammunition cartridge.
Figure 6:
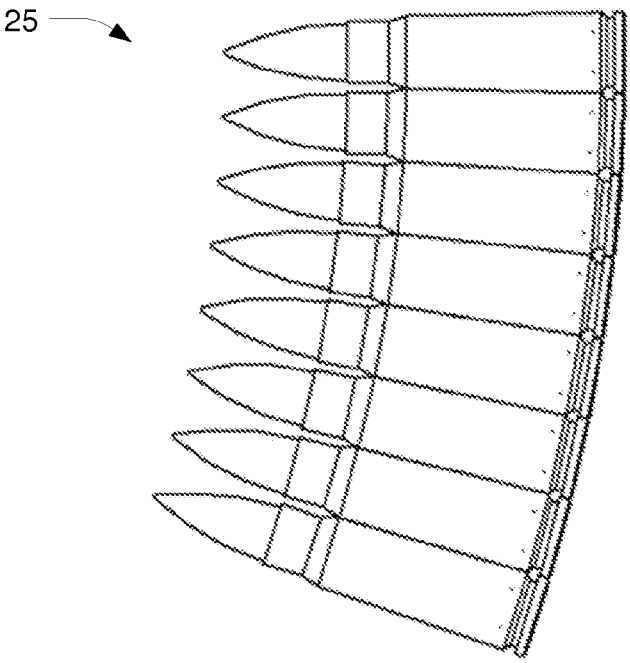
FIG. 6 (PRIOR ART)
FIG. 6 is a side view of a stack of M43 ammunition cartridges.
Figure 7:
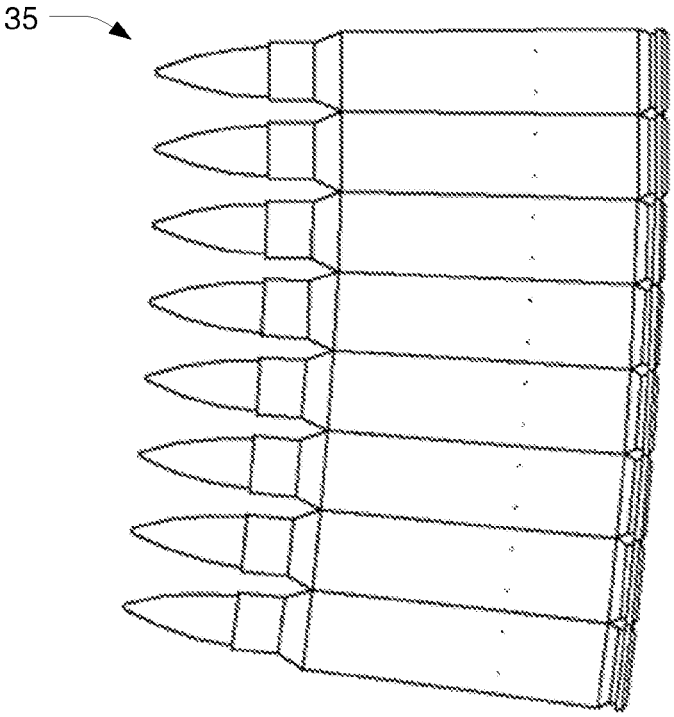
FIG. 7 (PRIOR ART)
FIG. 7 is a side view of a stack of 223 Remington ammunition cartridges.
Figure 8:
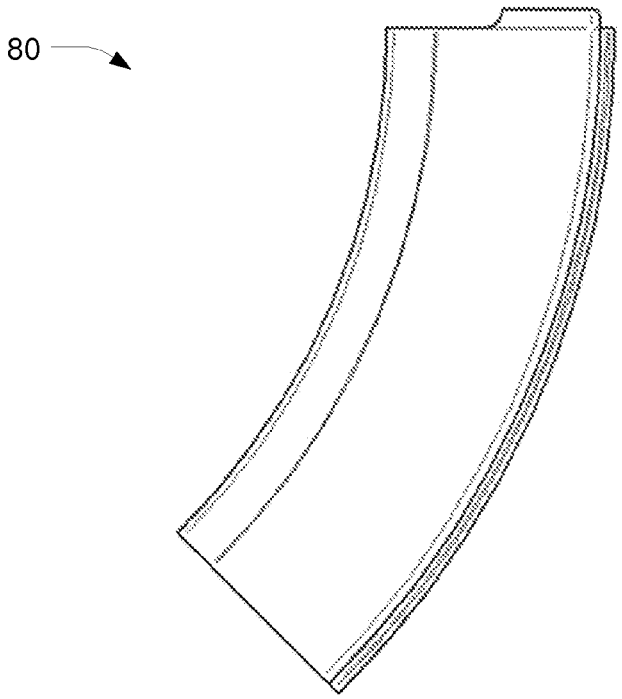
FIG. 8 (PRIOR ART)
FIG. 8 is a side view of an AK style magazine.
Figure 9:
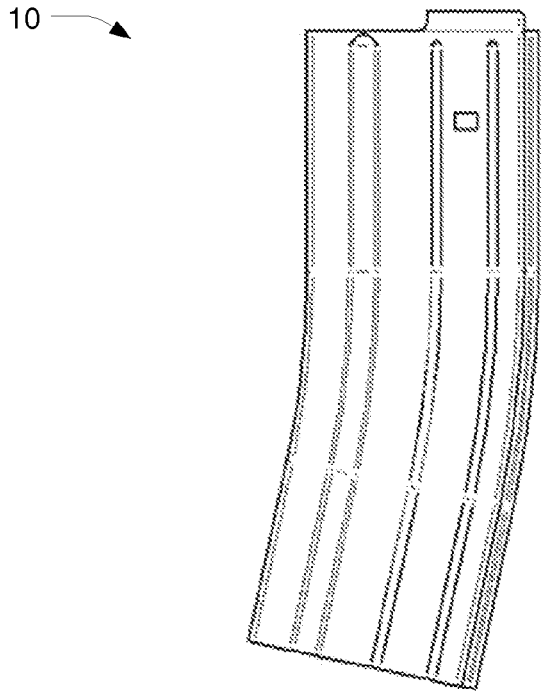
FIG. 9 (PRIOR ART)
FIG. 9 is a side view of a STANAG magazine.

The magazine shell 130 may include at least one reinforcement groove oriented in a longitudinal direction along a length of the magazine shell 130. In the example shown in FIG. 13, the magazine shell 130 includes multiple reinforcement grooves, on the exterior of each of the two primary sides of the magazine shell 130, which are oriented in a longitudinal direction along a length of the magazine shell 130. Compared to a conventional magazine shell design shown in FIG. 3, the design of reinforcement grooves of the magazine shell 130 is modified. That is, the reinforcement grooves of the magazine shell 130 have different cross-sectional diameters in different sections. In the example shown in FIG. 13, the reinforcement grooves are divided into several sections, namely sections 131, 132 and 133. Section 131 of the reinforcement grooves is designed in such a way that the reinforcement grooves are deeper and have larger cross-sectional diameter in section 131 than in section 133. Section 132 is a transition section that connects sections 131 and 133, such that the interior of section 132 forms a ramp that changes the minimum distance between reinforcement grooves on the two opposite primary surfaces of the magazine shell 130 from large to small in a direction from bottom toward the top of the magazine shell 130.

Figure 14:
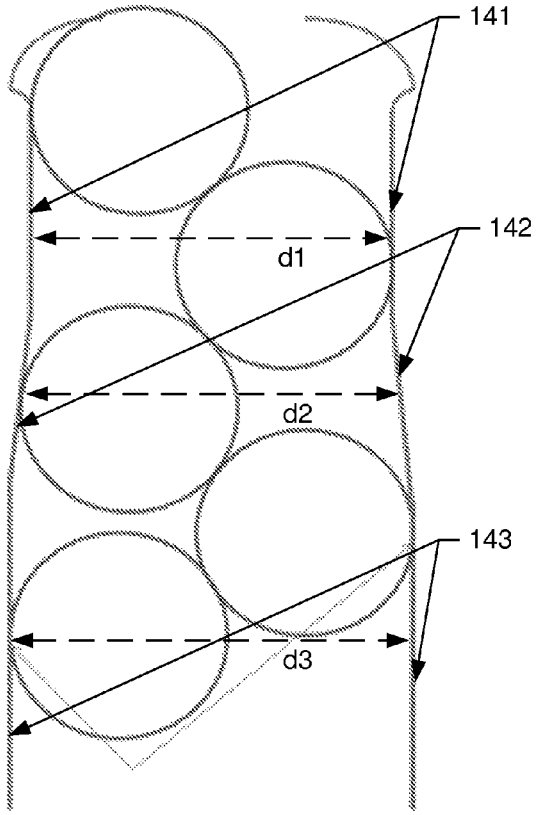
FIG. 14 is a cross-sectional view of an upper portion of the magazine shell design of FIG. 13 which is configured to hold ammunition cartridges of a relatively large rim diameter, viewing from rear to front of the magazine shell when in use with a firearm, in accordance with an embodiment of the present disclosure.
Figure 15:
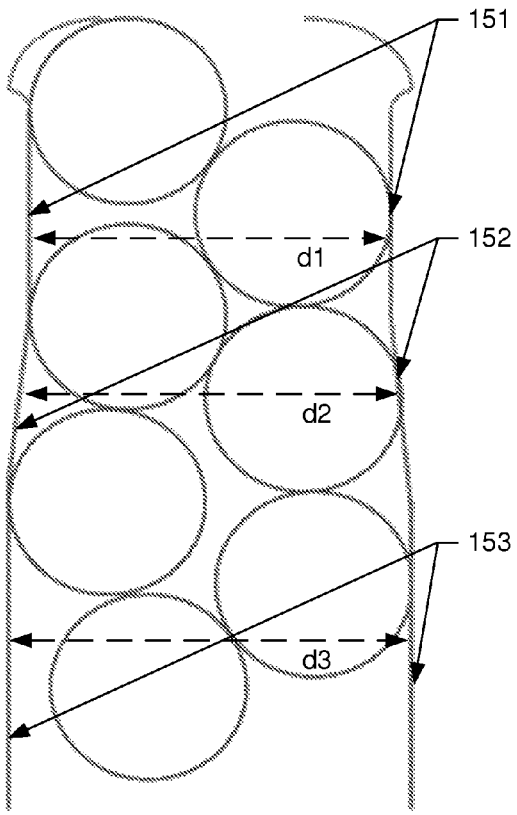
FIG. 15 is a cross-sectional view of an upper portion of the magazine shell design of FIG. 13 which is configured to hold ammunition cartridges of a smaller rim diameter, viewing from rear to front of the magazine shell when in use with a firearm, in accordance with an embodiment of the present disclosure.

FIG. 14 illustrates a cross-sectional view of an upper portion of the magazine shell design of FIG. 13 which is shown holding ammunition cartridges of a relatively large rim diameter, viewing from rear to front of the magazine shell when in use with a firearm, in accordance with an embodiment of the present disclosure. FIG. 15 illustrates a cross-sectional view of an upper portion of the magazine shell design of FIG. 13 (identical to that shown in FIG. 14) which is shown holding ammunition cartridges of a smaller rim diameter, viewing from rear to front of the magazine shell when in use with a firearm, in accordance with an embodiment of the present disclosure.

The position and alignment of the first two ammunition cartridges from the lip are the most important to ensure reliable feeding of all the ammunition cartridges held inside the magazine. As shown in FIGS. 14 and 15, looking from rear toward front, the design has a change in the width of the cross section from the bottom toward the top where the lip is located. Each of the lines 141, 142 and 143, as well as the lines 151, 152 and 153, depicts the valley (or bottom) of section 131, 132 or 133, respectively, of the reinforcement grooves of the magazine shell 130 shown in FIG. 13. In other words, the distance between the pair of lines 141 represent the minimum distance inside the magazine shell 130 at a height approximate section 131 of the reinforcement grooves. Likewise, the distance between the pair of lines 142 represent the minimum distance inside the magazine shell 130 at a height approximate section 132 of the reinforcement grooves. Similarly, the distance between the pair of lines 143 represent the minimum distance inside the magazine shell 130 at a height approximate section 133 of the reinforcement grooves. The same can be said with respect to the example shown in FIG. 15. With the designs shown in FIGS. 14 and 15, the distance d1 is smaller than the distance d2, which is smaller than the distance d3. Accordingly, with reinforcement grooves on a first primary side of the magazine shell 130 and a second primary side of the magazine shell 130 opposite to the first primary side, the cross-sectional distance between the inner surface of the first primary side and the inner surface of the second primary side generally decreases as viewed in a direction from the second end (e.g., bottom) toward the first end (e.g., top) of the magazine shell 130.

Figure 10:
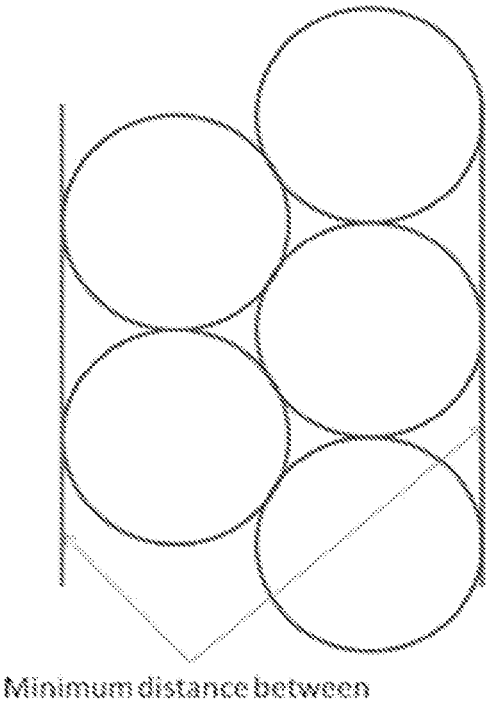
FIG. 10 is a cross-sectional view of a portion of a magazine shell configured to hold ammunition cartridges of a relatively large rim diameter, viewing from rear to front of the magazine shell when in use with a firearm, in accordance with an embodiment of the present disclosure.
Figure 11:
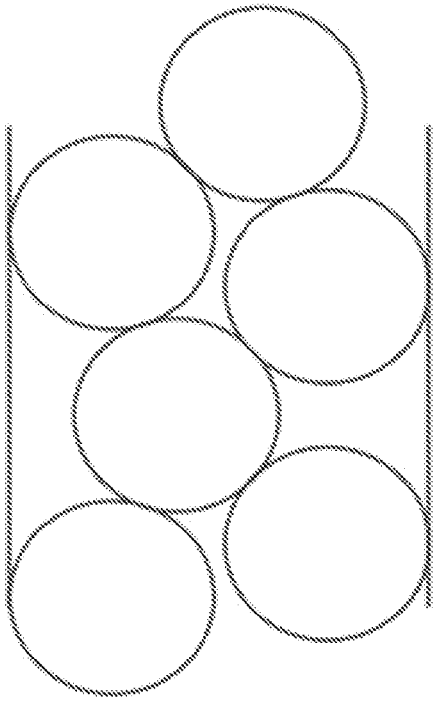
FIG. 11 is a cross-sectional view of a portion of a magazine shell configured to hold ammunition cartridges of a relatively large rim diameter while accommodating ammunition cartridges of a smaller rim diameter, viewing from rear to front of the magazine shell when in use with a firearm, in accordance with an embodiment of the present disclosure.
Figure 12:
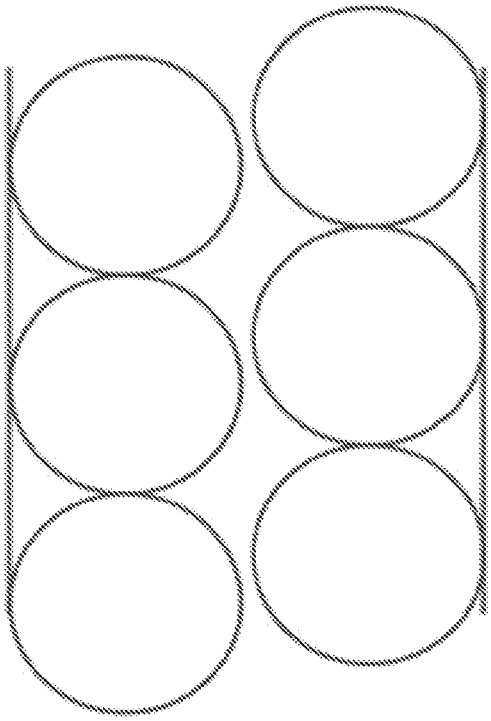
FIG. 12 is a cross-sectional view of a portion of a magazine shell configured to hold ammunition cartridges of a relatively large rim diameter while accommodating ammunition cartridges of a smaller rim diameter, viewing from rear to front of the magazine shell when in use with a firearm, in accordance with an embodiment of the present disclosure.

In one embodiment, as shown in FIGS. 14 and 15, close to the magazine lip on the top, the width of the cross section of the magazine shell 130 becomes smaller so that ammunition cartridges with smaller rim diameter can be stacked securely for at least the first two ammunition cartridges on the top of the stack of ammunition cartridges (e.g., as shown in FIG. 15). At the portion of the magazine shell 130 where the cross section is larger (e.g., between the two lines 143), ammunition cartridges with smaller rim diameter may be stacked in a less-stable manner; however, this would not affect the orientation of first two ammunition cartridges on the top of the stack of ammunition cartridges. Hence, reliable feeding of ammunition cartridges can still be achieved compared to the design described previously. As shown in FIG. 14, ammunition cartridges with larger rim diameter would be stacked less densely compared to those shown in FIG. 10, albeit still stacked stably. Therefore, the design in accordance with the present disclosure would feed ammunition cartridges with various rim diameters stably.

These and other objectives of the present disclosure will be appreciated by those of ordinary skill in the art after reading the following detailed description of the preferred embodiments that are illustrated in the various figures and drawings.

Figure 23:
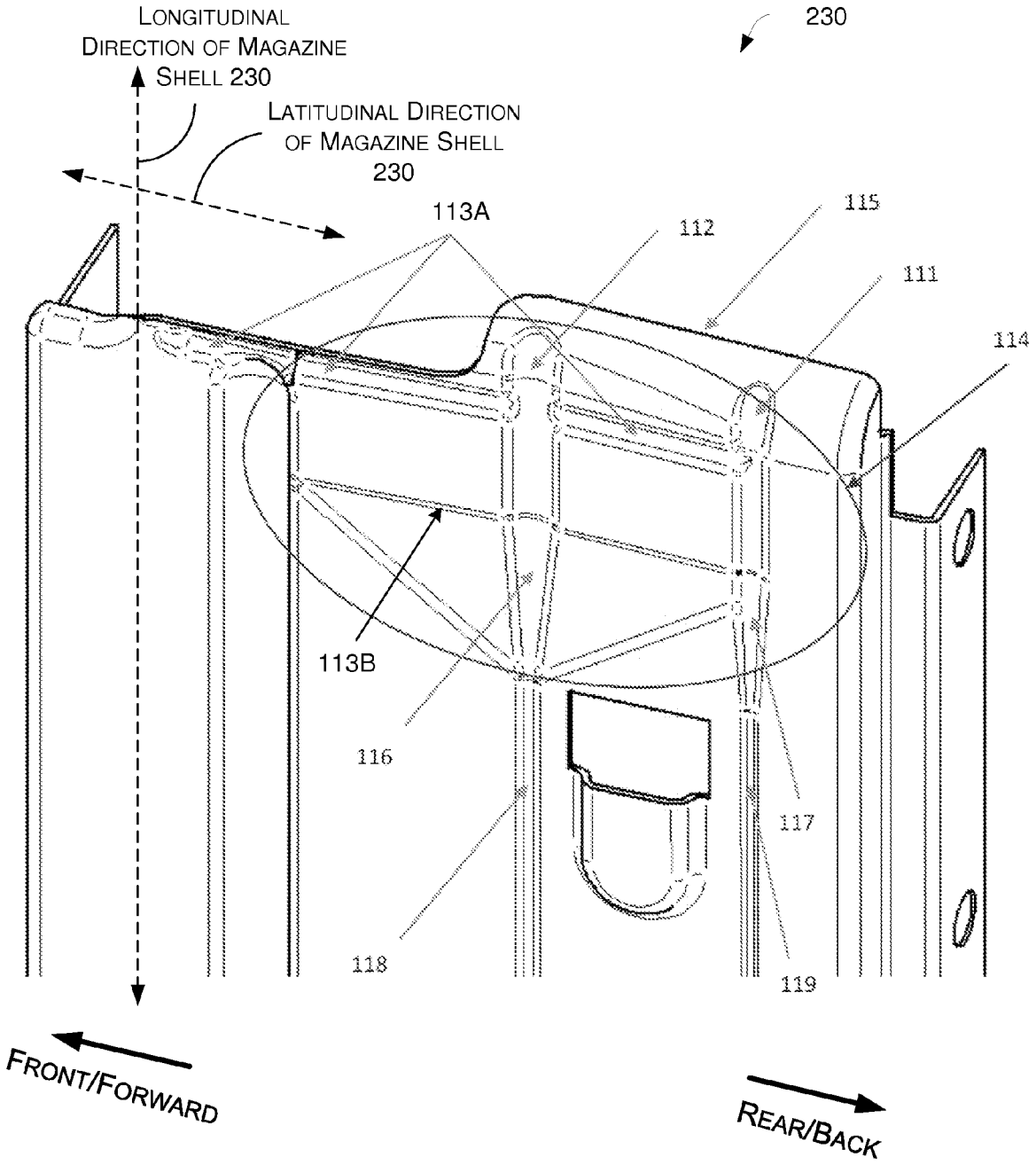
FIG. 23 is a perspective view of a magazine shell design without a magazine sidewall spring in accordance with another embodiment of the present disclosure.

Turning now to FIG. 23, FIG. 23 illustrates a magazine shell 230 without a separate magazine sidewall such as, for example, the magazine sidewall spring 102 shown in FIG. 2A. Referring to FIG. 2B, the universal magazine 100 may comprise a new magazine shell 101B that does not require a separate magazine sidewall spring such as the magazine sidewall spring 102 shown in FIG. 2A. The magazine shell 230 shown in FIG. 23 may be implemented as magazine shell 101B in the universal magazine 100 of FIG. 2B.

The magazine shell 230 may include at least one vertical reinforcement groove oriented in a longitudinal direction along a length of the magazine shell 230. In the example shown in FIG. 23, the magazine shell 230 includes multiple vertical reinforcement grooves, on the exterior of each of the two primary sides of the magazine shell 230, which are oriented in a longitudinal direction along a length of the magazine shell 230. Compared to a conventional magazine shell design shown in FIG. 3, the design of vertical reinforcement grooves of the magazine shell 230 is modified and improved. That is, the vertical reinforcement grooves of the magazine shell 230 have different cross-sectional diameters in different sections. In the example shown in FIG. 23, the vertical reinforcement grooves are divided into several sections. For instance, one of the vertical reinforcement grooves includes sections 111, 117 and 119, and another one of the vertical reinforcement grooves includes sections 112, 116 and 118. Section 111/112 of the vertical reinforcement grooves is designed in such a way that the vertical reinforcement grooves are deeper and may have larger cross-sectional diameter in section 111/112 than in section 119/118. Section 117/116 is a transition section that connects sections 111/112 and 119/118, respectively, such that the interior of section 117/116 forms a ramp that changes the minimum distance between vertical reinforcement grooves on the two opposite primary surfaces of the magazine shell 230 from large to small in a direction from bottom toward the top of the magazine shell 230. Section 117/116 has a gradually changing cross-sectional diameter (or width), which is greatest at a connection point where section 117/116 connects with section 111/112 and smallest at a connection point where section 117/116 connects with section 119/118.

Sections 111 and 112 are the deeper and wider sections of the respective vertical reinforcement grooves. In some embodiments, between sections 111 and 112, section 111 may be proportionally shallower and narrower than section 112. Likewise, in some embodiments, section 117 may be proportionally shallower and narrower than section 116, and section 119 may be proportionally narrower and shallower than section 118. That is, in some embodiments, some of the vertical reinforcement grooves have different dimensions. For example, the vertical reinforcement groove formed by sections 111, 117 and 119 may be different (e.g., proportionally shallower and narrower) than the vertical reinforcement groove formed by sections 112, 116 and 118. Accordingly, the cross-sectional diameter as well as width of at least one of the one or more vertical reinforcement grooves may vary at different sections along the longitudinal direction of the magazine shell 230. Put differently, at least one of the one or more vertical reinforcement grooves may have different cross-sectional diameters (or widths) at various sections along the longitudinal direction of the magazine shell 230.

Both sections 111 and 112 of the respective vertical reinforcement grooves extend from a side of the main body portion of the magazine shell 230 to a feeding lip 115 of the magazine shell 230. This design provides continuous side support of the internal magazine to the ammunition cartridge. Feeding lip 115 extends from an upper rim of the main body portion of the magazine shell 230 and has a curvature that curves inwardly toward the inner side of the magazine shell 230. In some embodiments, the radius and the depth of sections 111 and 112 are gradually increased toward the feeding lip 115 such that sections 111 and 112 turn into a "flare-out" or dovetail shape and that the strength of the feeding lip 115 is enhanced.

In some embodiments, on each of a first primary sidewall and a second primary sidewall opposite the first primary sidewall of the magazine shell 230, the magazine shell 230 may also include one horizontal reinforcement groove that extends along a latitudinal direction (perpendicular to the longitudinal direction of the magazine shell 230) to strengthen the upper area of the magazine shell 230. As shown in FIG. 23, a horizontal reinforcement groove 113A is disposed near the upper rim of the main body portion of the magazine shell 230, and may be adjacent to the base portion of feeding lip 115. Also shown in FIG. 23, another horizontal reinforcement groove 113B is adjacent the horizontal reinforcement groove 113A and intersects with section 116 of one vertical reinforcement groove as well as section 117 of another vertical reinforcement groove. In particular, the horizontal reinforcement groove is located below the upper ridge line of the magazine shell 230, e.g., below the edge of each of the first primary sidewall and the second primary sidewall at the end of the magazine shell having an opening. This design feature is important for at least two reasons. Firstly, if the ridge line of the magazine shell is reinforced by bending a few "wrinkles" on the sidewall(s) of the magazine shell inward to form reinforcement "lips", depending on the shape of the ammunition cartridges to be used with magazine shell, one or more ammunition cartridges may possibly hit the reinforce "lips" and result in damage to the ammunition cartridges during the feeding; and this may undesirably result in failure of feeding the ammunition cartridges into the chamber of the firearm. Moreover, for users who reload the firearm with used casings of ammunition cartridges, the above-described damage is certainly not welcome. The design of the present disclosure eliminates this problem. Secondly, adding horizontal reinforcement groove(s) may introduce magazine follower jam inside of the magazine. This is why horizontal reinforcement groove 113A is shallower than the vertical reinforcement grooves. The one horizontal reinforcement groove may intersect with at least one of the one or more vertical reinforcement grooves. For example, as shown in FIG. 23, the horizontal reinforcement groove 113A intersects with at least section 112 and section 111 of two of the vertical reinforcement grooves.

In some embodiments, the magazine shell 230 may include a concave area 114. In some embodiments, concave area 114 is located approximately toward an upper part of the main body portion of the magazine shell 230, and may partially extend into a base portion of the feeding lip 115 that connects the feeding lip 115 to the main body portion of the magazine shell 230. The concave area 114 on the respective side of the magazine shell 230 is configured to concave inwardly toward the interior of the main body portion of the magazine shell 230. This design allows the main body portion of the magazine shell 230 in the concave area 114 to function as a spring, thus removing the need for a separate magazine sidewall such as, for example, the magazine sidewall spring 102 shown in FIG. 2A. In some embodiments, concave area 114 may be centered on the vertical reinforcement groove formed by sections 112, 116 and 118 along the latitudinal direction of the magazine shell 230.

Due to the stacking relationship between each other ammunition cartridge of the doubled stacked cartridges, in the case that one or more smaller-diameter ammunition cartridges are inserted into the magazine, concave area 104 on both sides of the magazine shell 230 may provide additional support to sections 111 and 112 of the reinforcement grooves to hold the ammunition cartridges tightly together. In the case that one or more larger-diameter ammunition cartridges are inserted into the magazine, the concave area 114 on both sides of the magazine shell 230 may aid in transferring the main spring force transversely from an upward direction to an outward direction on both sides of the magazine shell 230, due to the smaller interior depth of the magazine.

In some embodiments, concave area 114 may be configured to deform by bulging out to provide more room for the ammunition cartridges. This feature effectively turns the main body portion of the magazine shell 230 into a magazine body spring, while at the same time serving as a compensator as the magazine deforms in the area around concave area 114. Accordingly, the outward deformation, or bulging out, of concave area 114 would not be excessive and thus the loaded magazine (with ammunition cartridges contained therein) may still be freely inserted into and dropped from the firearm.

It is noteworthy that, although the above-described features and illustration of magazine shell 130 and 230 in FIGS. 13 and 23 pertain to one primary side of the magazine shell 130 and 230, all of the above-described features are applicable to both primary sides of the magazine shell 130 and 230, respectively.

Example Embodiments of Magazine Sidewall Spring

Figure 16:
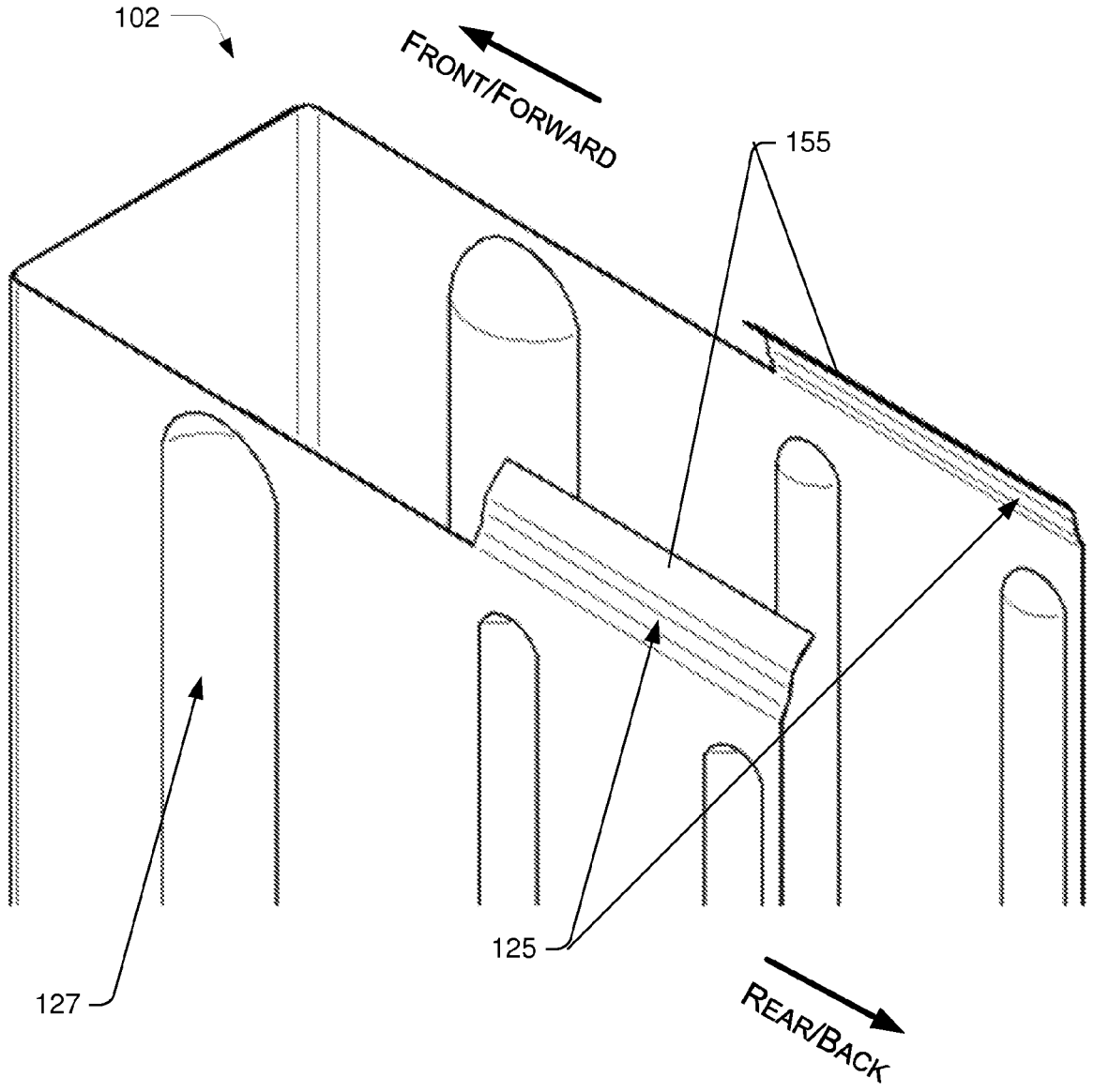
FIG. 16 is a perspective view of a self-adjusting magazine sidewall spring of a universal magazine in accordance with an embodiment of the present disclosure.
Figure 17:
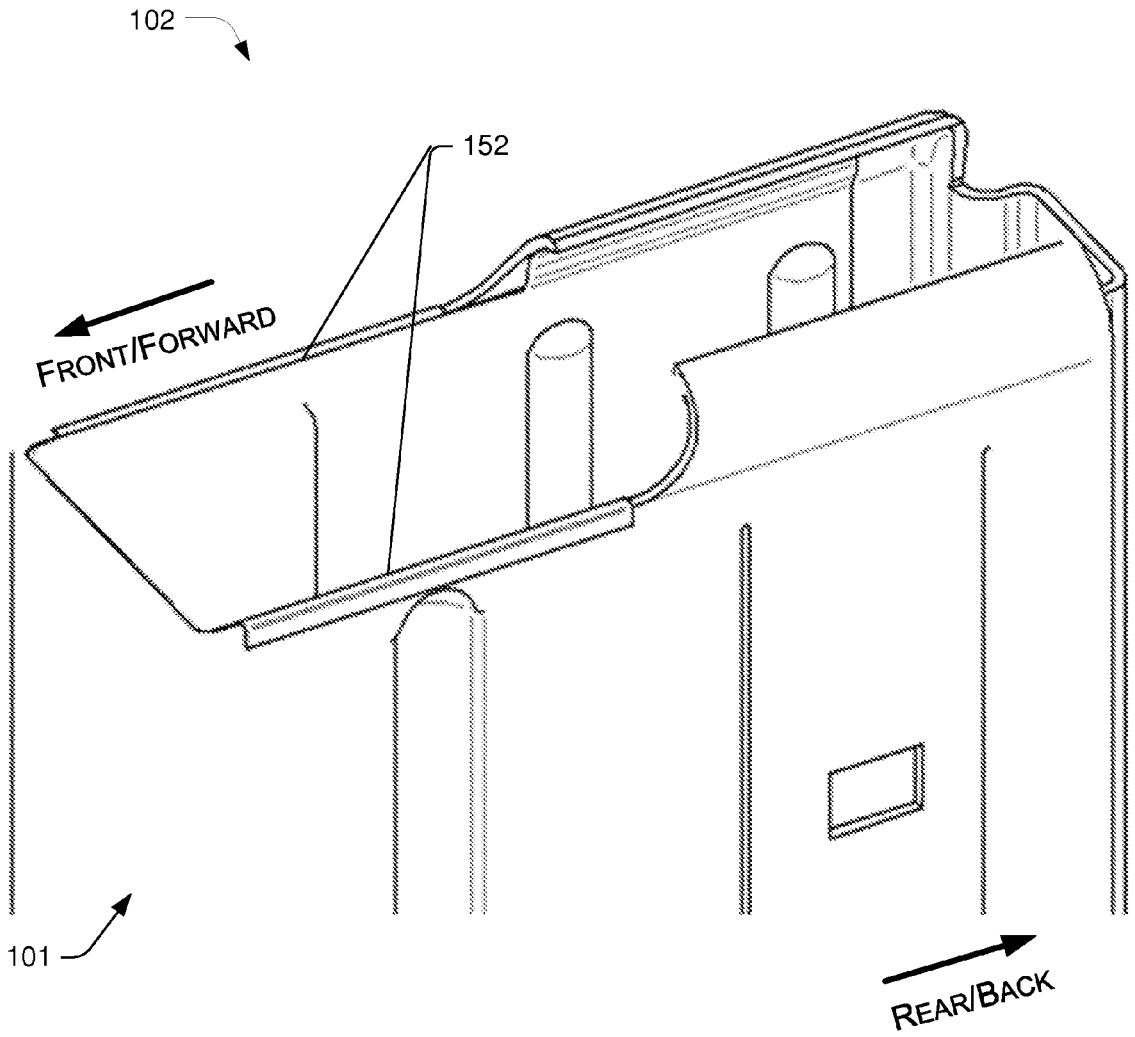
FIG. 17 is a perspective view of the self-adjusting magazine sidewall spring of FIG. 20 fitted inside a magazine shell of a universal magazine in accordance with an embodiment of the present disclosure.

FIG. 16 illustrates the self-adjusting magazine sidewall spring 102 of the universal magazine 100 in accordance with an embodiment of the present disclosure. FIG. 17 illustrates the self-adjusting magazine sidewall spring 102 of FIG. 16 fitted inside the magazine shell 101 of the universal magazine 100 in accordance with an embodiment of the present disclosure.

The self-adjusting deformable magazine sidewall spring 102 is received in the magazine shell 101 and fitted along an internal surface of the magazine shell 101. The deformable magazine sidewall spring 102 provides side support to one or more ammunition cartridges when the one or more ammunition cartridges are held in the magazine shell 101 and in contact with the deformable magazine sidewall spring 102. In particular, the deformable magazine sidewall spring 102 provides the side support by deforming and exerting a third force on the one or more ammunition cartridges in directions generally perpendicular to the sidewalls of the magazine shell 101.

In at least one implementation, the deformable magazine sidewall spring 102 comprises a thin sheet metal.

In at least one implementation, the deformable magazine sidewall spring 102 has an outer surface contoured to match an inner surface of the sidewalls of the magazine shell 101. For example, the sidewalls of the magazine shell 101 may include one or more reinforcement grooves. Correspondingly, the deformable magazine sidewall spring 102 may include a plurality of grooves 127 that correspond to and match the one or more reinforcement grooves of the magazine shell 101.

In at least one implementation, the deformable magazine sidewall spring 102 includes one or more protrusions 152 that extend outside the magazine shell 101 and contact an external surface of the magazine shell 101 when the deformable magazine sidewall spring 102 is received in the magazine shell 101. The one or more protrusions 152 advantageously reinforce the sealing between the deformable magazine sidewall spring 102 and the magazine shell 101.

In at least one implementation, the deformable magazine sidewall spring 102 includes one or more protrusions 155 that extend into a feeding lip of the magazine shell 101. Each of the one or more protrusions 155 forms one or more respective bump 125 a ridgeline of which is generally parallel with a ridgeline of the feeding lip of the magazine shell 101. The one or more bumps 125 advantageously provide guidance support to one or more ammunition cartridges of different calibers when the one or more ammunition cartridges are pushed out of the magazine shell 101 and into a firing chamber of the firearm by a bolt of the firearm.

As shown in FIGS. 16 and 17, on the top of the deformable magazine sidewall spring 102, the one or more grooves 127 gradually flatten out to leave no gap between the deformable magazine sidewall spring 102 and the inner surface of the magazine shell 101, so that dirt or debris would not come between them to cause malfunction. As shown in FIG. 17, the front portion of the deformable magazine sidewall spring 102 includes one or more protrusions 152 that extend outside of the magazine shell 101 and flap back to make contact with the external surface of the magazine shell 101 to make even better sealing with the magazine shell 101. This feature advantageously protects the portion of the deformable magazine sidewall spring 102 at the beginning of the one or more grooves 127 from cracking.

As shown in FIG. 16, the one or more protrusions 155 of the deformable magazine sidewall spring 102 extend into the magazine feeding lip area (not shown). The one or more grooves 125 are formed on the upper side location to provide guidance force (support) for ammunition cartridges, regardless of the caliber, when the firearm bolt (not shown) pushes the top ammunition cartridge out of the universal magazine 100 and into the firing chamber of the firearm. The rear side of the deformable magazine sidewall spring 102 may be open and there is a gap between the rear side of the deformable magazine sidewall spring 102 and the rear side of the magazine shell 101. This is necessary to allow the deformable magazine sidewall spring 102 to expand in the case that ammunition cartridges of large case diameters are used.

Figure 18:
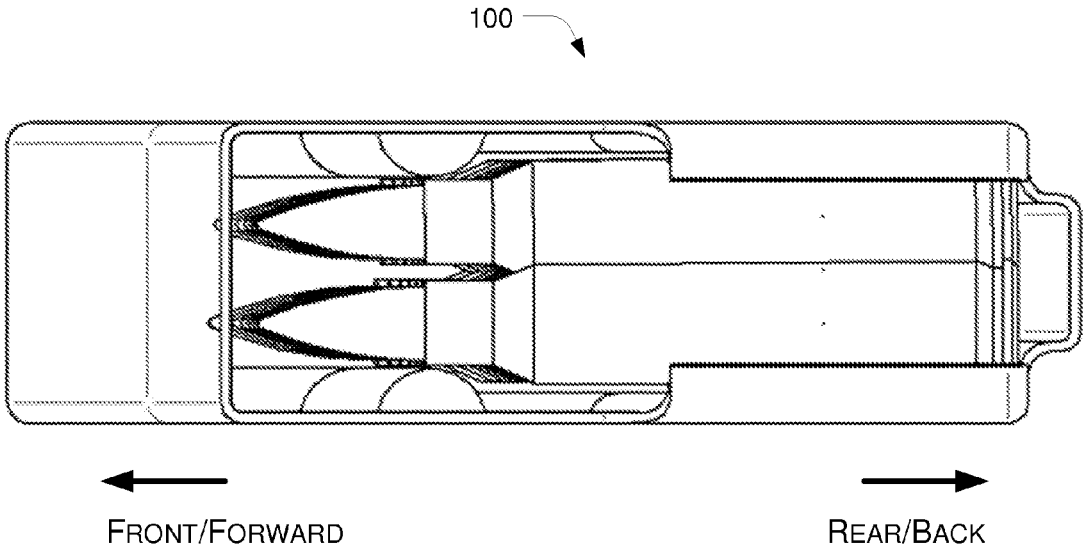
FIG. 18 is a top view of ammunition cartridges stacked inside a universal magazine in accordance with a further embodiment of the present disclosure.
Figure 19:
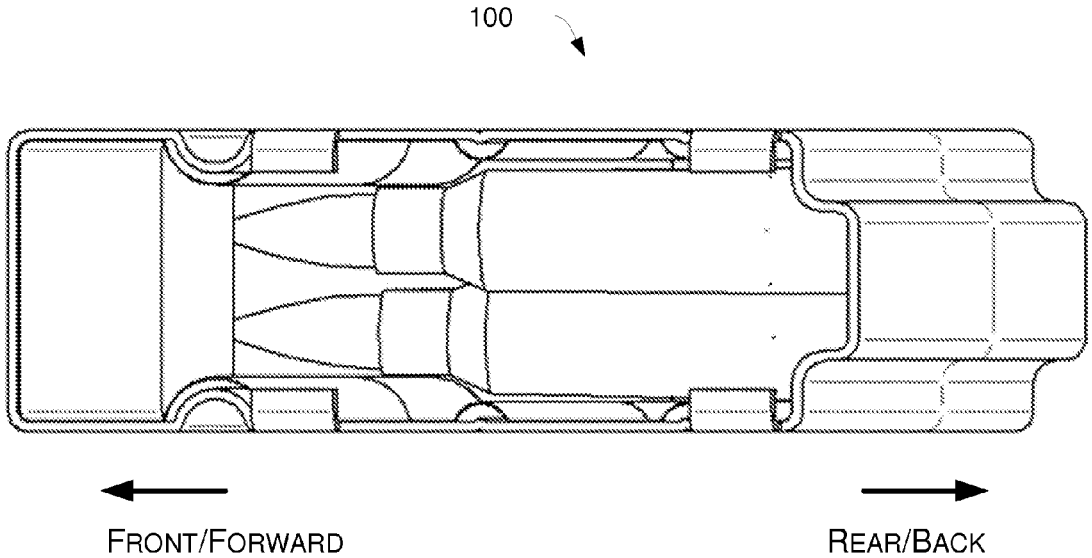
FIG. 19 is a bottom view of ammunition cartridges stacked inside a universal magazine in accordance with a further embodiment of the present disclosure.

FIG. 18 is a top view of ammunition cartridges stacked inside the universal magazine 100 in accordance with a further embodiment of the present disclosure. FIG. 19 is a bottom view of ammunition cartridges stacked inside the universal magazine 100 in accordance with a further embodiment of the present disclosure.

As shown in FIGS. 18 and 19, when ammunition cartridges are stacked inside the universal magazine 100, it is important to provide side support to the ammunition cartridges especially for double stackable cartridges. The internal width of the magazine shell 101 is designed to accommodate the largest casing diameter of the available calibers so the internal wall of the magazine shell 101, plus the pressed down deformable magazine sidewall spring 102, will provide such side support to the ammunition cartridges. However, when ammunition cartridges of smaller casing diameter are inserted in a conventional magazine, the sidewalls of the conventional magazine is not able to provide such side support. This is when the deformable magazine sidewall spring 102 comes into play. As shown in FIG. 2A, the deformable magazine sidewall spring 102 is stamped into a similar shape as that of the magazine shell 101, except the backside of the deformable magazine sidewall spring 102 is not enclosed as the magazine shell 101 is. The deformable magazine sidewall spring 102 is made by very thin sheet metal, and it has at least two grooves 127 on each side, one on the front, and one (two shown) on the back. These grooves 127 are deeper than their matching reinforcement grooves on the magazine shell 101. When installed inside of the magazine shell 101, the grooves 127 will deform as they are pressed by the stacked ammunition cartridges. The deformation of the grooves 127 is minimal for ammunition cartridges having the smallest casing diameter. The deformation of the grooves 127 is maximal for ammunition cartridges having the largest casing diameter. Accordingly, this feature advantageously provides side support for ammunition cartridges of all possible calibers.

Figure 20:
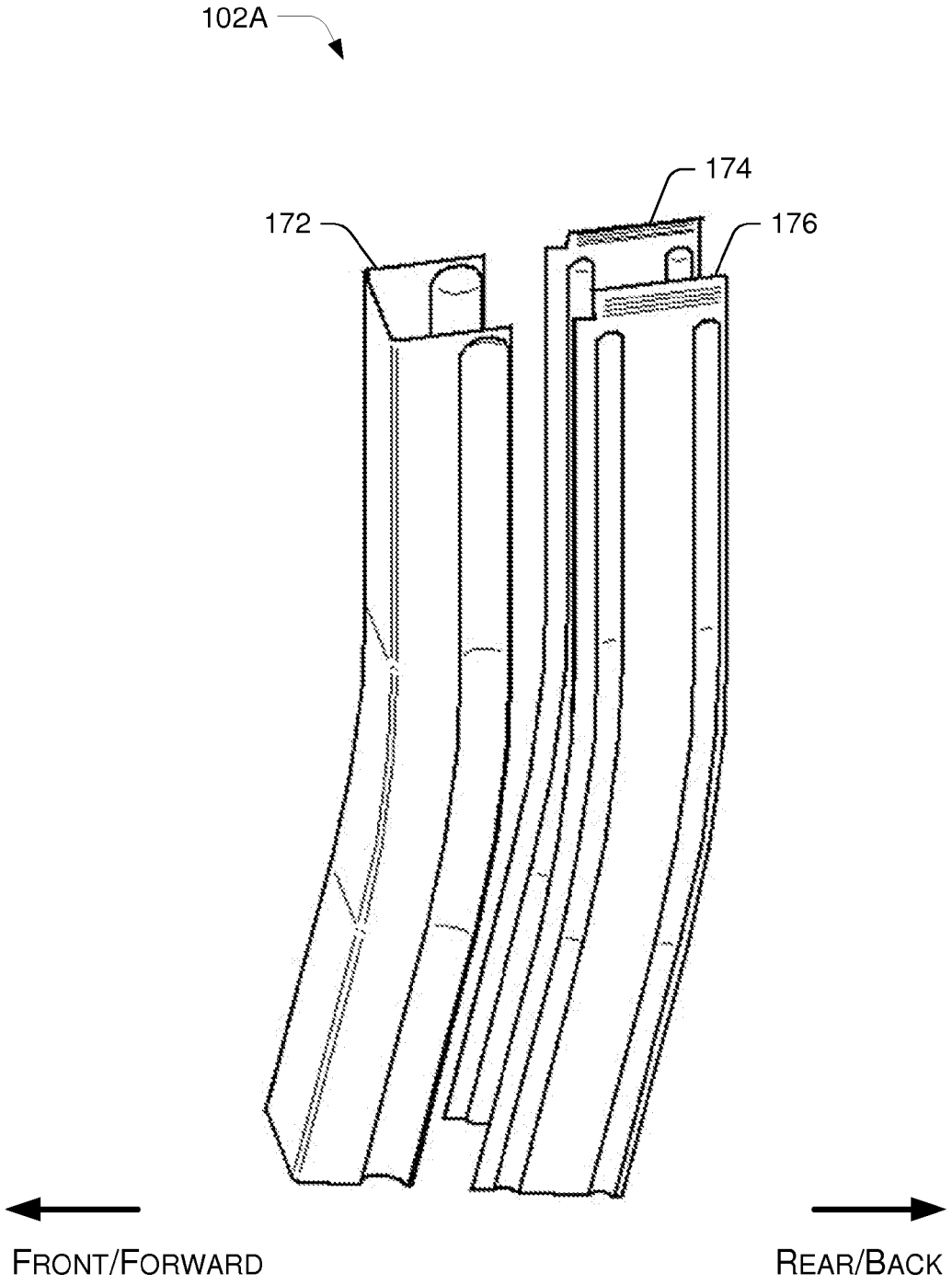
FIG. 20 is a perspective view of a self-adjusting magazine sidewall spring of a universal magazine in accordance with another embodiment of the present disclosure.

FIG. 20 illustrates another example of the self-adjusting magazine sidewall spring 102. Compared to the example shown in FIGS. 16 and 17, which features a one-piece design, the magazine sidewall spring 102*a* in the example depicted in FIG. 20 is a three-piece design including a front piece 172 and two side pieces 174 and 176. Each of the front piece 172 and the two side pieces 174 and 176 may be made of, for example, a thin sheet metal. Other than the difference just described, the example of the self-adjusting magazine sidewall spring 102A of FIG. 20 has the same features and functionality as those of FIGS. 16 and 17. Thus, in the interest of brevity, detailed description of the example of the self-adjusting magazine sidewall spring 102A of FIG. 20 will not be provided.

Figure 21:
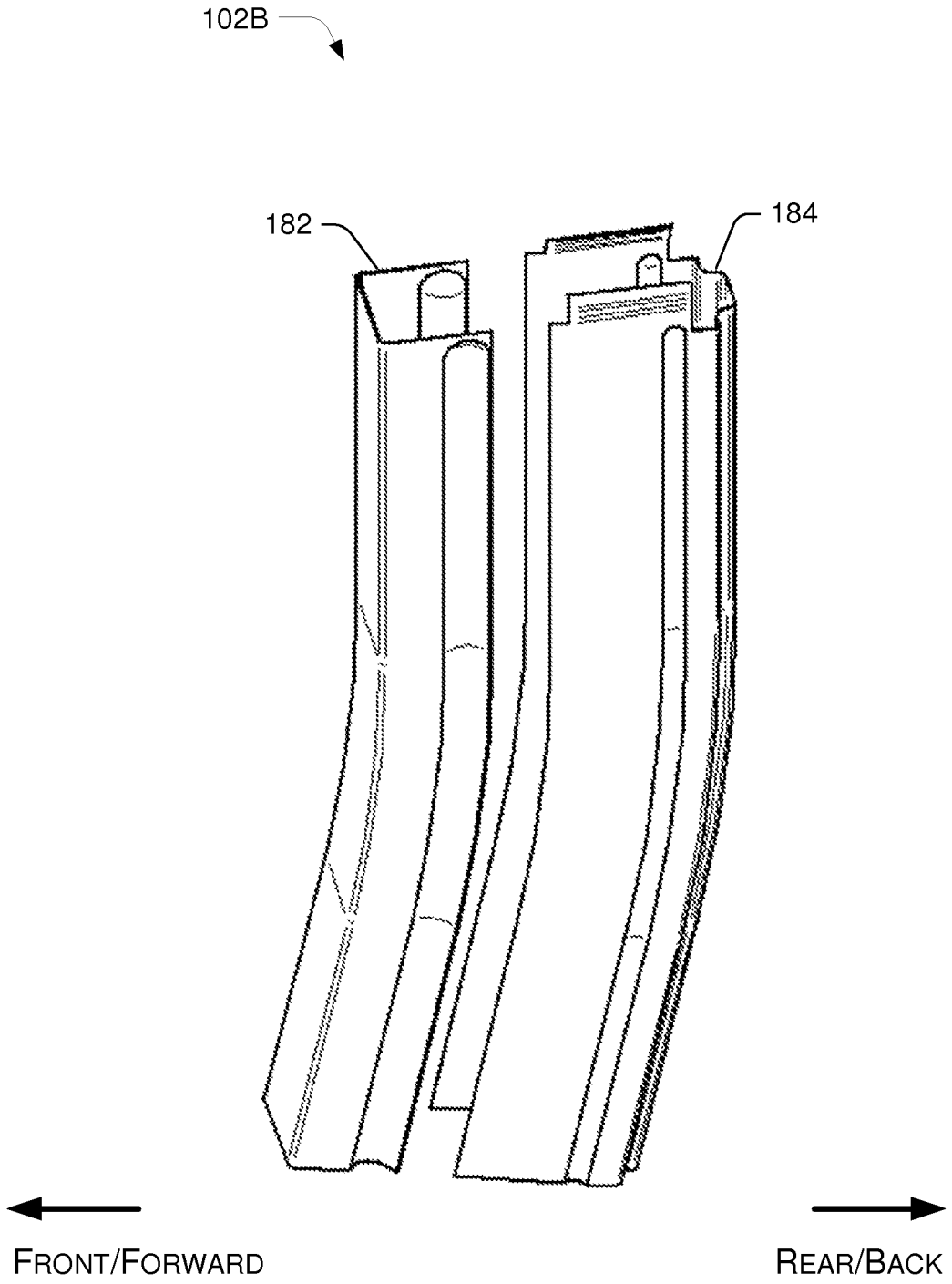
FIG. 21 is a perspective view of a self-adjusting magazine sidewall spring of a universal magazine in accordance with a further embodiment of the present disclosure.

FIG. 21 illustrates a further example of the self-adjusting magazine sidewall spring 102. In comparison with the example shown in FIGS. 16 and 17 and the example shown in FIG. 20, the magazine sidewall spring 102B in the example depicted in FIG. 21 is a two-piece design including a front piece 182 and a rear piece 184. Each of the front piece 182 and the rear piece 184 may be made of, for example, a thin sheet metal. Other than the difference just described, the example of the self-adjusting magazine sidewall spring 102B of FIG. 21 has the same features and functionality as those of FIGS. 16 and 17. Thus, in the interest of brevity, detailed description of the example of the self-adjusting magazine sidewall spring 102B of FIG. 21 will not be provided.

Figure 22:
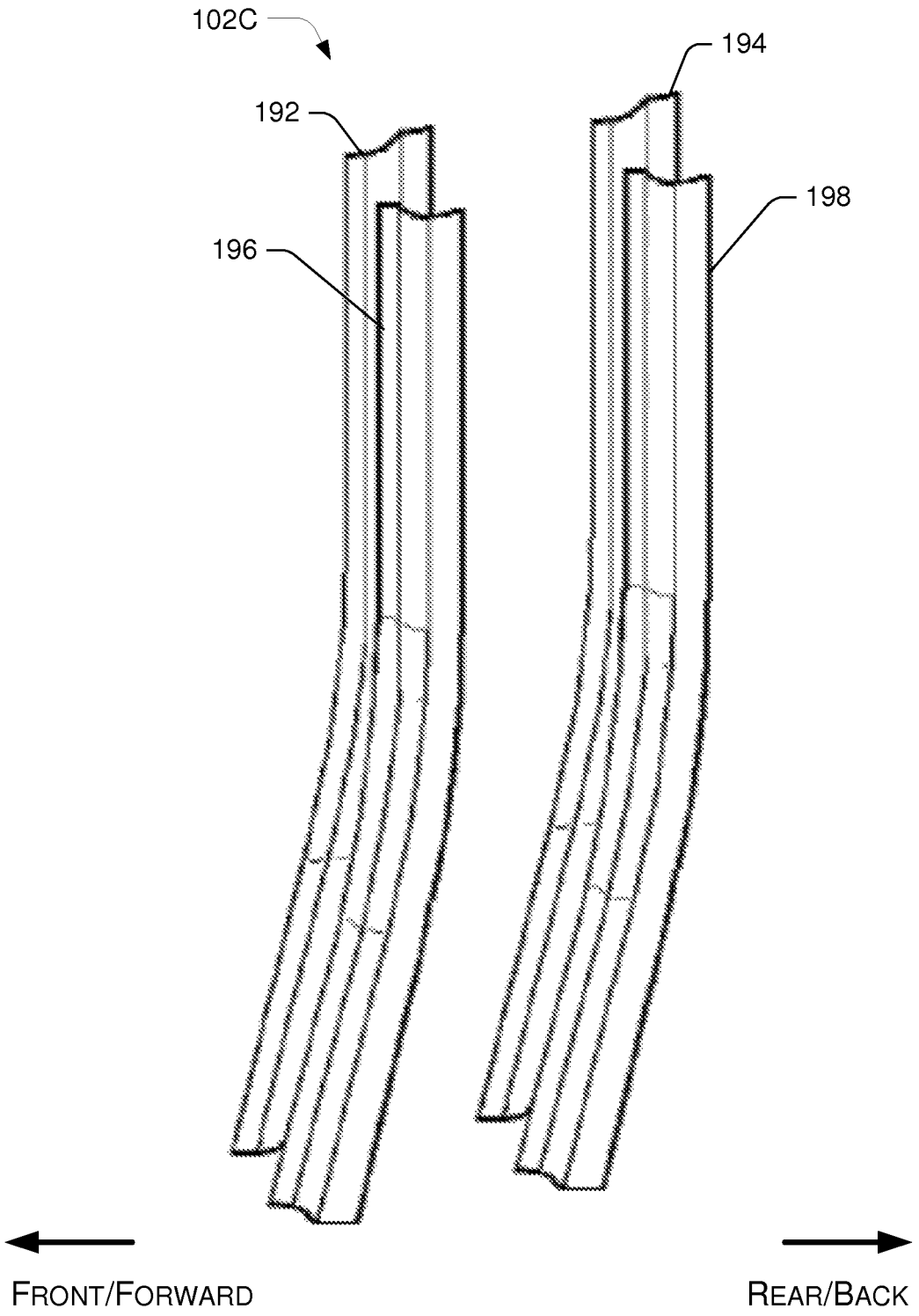
FIG. 22 is a perspective view of a self-adjusting magazine sidewall spring of a universal magazine in accordance with yet another embodiment of the present disclosure.

FIG. 22 illustrates yet another example of the self-adjusting magazine sidewall spring 102. In comparison with the example shown in FIGS. 16 and 17 and the example shown in FIGS. 20 and 21, the magazine sidewall spring 102C in the example depicted in FIG. 22 is a two-leaf-springs-in-two-rows design, including a first front half piece 192, a second front half piece 196, a first rear half piece 194, and a second rear half piece 198. Each of the front half pieces 192, 196 and the rear half pieces 194, 198 may be made of, for example, a thin sheet metal. Other than the difference just described, the example of the self-adjusting magazine sidewall spring 102C of FIG. 22 has the same features and functionality as those of FIGS. 16 and 17. Thus, in the interest of brevity, detailed description of the example of the self-adjusting magazine sidewall spring 102C of FIG. 22 will not be provided.

In short, in various embodiments, different designs of the self-adjusting sidewall spring, such as those shown in FIGS. 16, 17, 20, 21 and 22, may be used in combination with the magazine shell design shown in FIG. 13.

In view of the above, highlights of certain features of various embodiments of the present disclosure are provided below.

In one aspect, a magazine for a firearm may include a magazine shell and a magazine sidewall spring receivable in the magazine shell. The magazine shell may have a first end, a second end opposite the first end, and a plurality of sidewalls between the first end and the second end. The first end may have an opening and configured to attach to the firearm. The second end may include a bottom plate. At least a first primary sidewall of the sidewalls may include at least one vertical reinforcement groove each of which extending along a longitudinal direction of the magazine shell. The magazine sidewall spring may have an outer surface contour corresponding to an inner surface contour of at least some of the sidewalls of the magazine shell. The magazine sidewall spring may include at least one deformable groove each of which corresponding to a respective one of the at least one vertical reinforcement groove of the magazine shell.

In some embodiments, the first primary sidewall of the magazine shell may also include a feeding lip extending with a curvature from the first primary sidewall at the first end of the magazine shell.

In some embodiments, one or more vertical reinforcement grooves of the at least one vertical reinforcement may extend into the curvature of the feeding lip.

In some embodiments, a first vertical reinforcement groove of the at least one vertical reinforcement groove may include first, second and third sections with the first section closer to the first end of the magazine shell than the second and third sections and with the second section disposed between the first and third sections. A cross-sectional diameter of the first section of the first vertical reinforcement groove may be different from a cross-sectional diameter of the third section of the first vertical reinforcement groove. A cross-sectional diameter of the second section of the first vertical reinforcement groove may change between the first section and the third section of the first vertical reinforcement groove.

In some embodiments, a second vertical reinforcement groove of the at least one vertical reinforcement groove may include first, second and third sections with the first section closer to the first end of the magazine shell than the second and third sections and with the second section disposed between the first and third sections. A cross-sectional diameter of the first section of the second vertical reinforcement groove may be different from a cross-sectional diameter of the third section of the second vertical reinforcement groove. A cross-sectional diameter of the second section of the second vertical reinforcement groove may change between the first section and the third section of the second vertical reinforcement groove.

In some embodiments, the first vertical reinforcement groove may be closer, than the second vertical reinforcement groove, to a sidewall of the magazine shell configured to face a rear end of each of one or more ammunition cartridges when the one or more ammunition cartridges are received in the magazine shell. The first section of the first vertical reinforcement groove may be proportionally shallower than the first section of the second vertical reinforcement groove.

In some embodiments, the first primary sidewall of the magazine shell may also include a feeding lip extending with a curvature from the first primary sidewall at the first end of the magazine shell. A radius of at least one of the first vertical reinforcement groove or the second vertical reinforcement groove may gradually increase toward the feeding lip to have a flare-out shape such that a strength of the feeding lip is increased.

In some embodiments, the first primary sidewall of the magazine shell may further include a horizontal reinforcement groove extending along a latitudinal direction of the magazine shell that is perpendicular to the longitudinal direction of the magazine shell. The horizontal reinforcement groove may intersect with one or more of the at least one vertical reinforcement groove.

In some embodiments, the horizontal reinforcement groove may be disposed in a proximity of and adjacent to an edge of the first primary sidewall at the first end of the magazine shell.

In some embodiments, the first primary sidewall of the magazine shell may further include a deformable concave area that caves inward with respect to the magazine shell such that the concave area bulges outward with respect to the magazine shell to accommodate one or more ammunition cartridges with of a first caliber and that the concave area does not bulge outward to accommodate one or more ammunition cartridges of a second caliber smaller than the first caliber.

In another aspect, a magazine for a firearm may include a magazine shell. The magazine shell may have a first end, a second end opposite the first end, and a plurality of sidewalls between the first end and the second end. The first end may have an opening and configured to attach to the firearm. The second end may include a bottom plate. At least a first primary sidewall of the sidewalls may include a deformable concave area that caves inward with respect to the magazine shell such that the concave area bulges outward with respect to the magazine shell to accommodate one or more ammunition cartridges with of a first caliber and that the concave area does not bulge outward to accommodate one or more ammunition cartridges of a second caliber smaller than the first caliber.

In some embodiments, the magazine may further include a magazine sidewall spring receivable in the magazine shell. The magazine sidewall spring may have an outer surface contour corresponding to an inner surface contour of at least some of the sidewalls of the magazine shell. The first primary sidewall of the magazine shell may also include at least one vertical reinforcement groove each of which extending along a longitudinal direction of the magazine shell. The magazine sidewall spring may include at least one deformable groove each of which corresponding to a respective one of the at least one vertical reinforcement groove of the magazine shell.

In some embodiments, the first primary sidewall of the magazine shell may further include a feeding lip extending with a curvature from the first primary sidewall at the first end of the magazine shell.

In some embodiments, one or more vertical reinforcement grooves of the at least one vertical reinforcement may extend into the curvature of the feeding lip.

In some embodiments, a first vertical reinforcement groove of the at least one vertical reinforcement groove may include first, second and third sections with the first section closer to the first end of the magazine shell than the second and third sections and with the second section disposed between the first and third sections. A cross-sectional diameter of the first section of the first vertical reinforcement groove may be different from a cross-sectional diameter of the third section of the first vertical reinforcement groove. A cross-sectional diameter of the second section of the first vertical reinforcement groove may change between the first section and the third section of the first vertical reinforcement groove.

In some embodiments, a second vertical reinforcement groove of the at least one vertical reinforcement groove may include first, second and third sections with the first section closer to the first end of the magazine shell than the second and third sections and with the second section disposed between the first and third sections. A cross-sectional diameter of the first section of the second vertical reinforcement groove may be different from a cross-sectional diameter of the third section of the second vertical reinforcement groove. A cross-sectional diameter of the second section of the second vertical reinforcement groove may change between the first section and the third section of the second vertical reinforcement groove.

In some embodiments, the first vertical reinforcement groove may be closer, than the second vertical reinforcement groove, to a sidewall of the magazine shell configured to face a rear end of each of one or more ammunition cartridges when the one or more ammunition cartridges are received in the magazine shell. The first section of the first vertical reinforcement groove may be proportionally shallower than the first section of the second vertical reinforcement groove.

In some embodiments, the first primary sidewall of the magazine shell may also include a feeding lip extending with a curvature from the first primary sidewall at the first end of the magazine shell. A radius of at least one of the first vertical reinforcement groove or the second vertical reinforcement groove may gradually increase toward the feeding lip to have a flare-out shape such that a strength of the feeding lip is increased.

In some embodiments, the first primary sidewall of the magazine shell may further include a horizontal reinforcement groove extending along a latitudinal direction of the magazine shell that is perpendicular to the longitudinal direction of the magazine shell.

In some embodiments, the horizontal reinforcement groove may be disposed in a proximity of and adjacent to an edge of the first primary sidewall at the first end of the magazine shell. The horizontal reinforcement groove may intersect with one or more of the at least one vertical reinforcement groove.

CONCLUSION

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims and their equivalents.

What is claimed is:

1. A magazine for a firearm, comprising:

a magazine shell having a first end, a second end opposite the first end, and a plurality of sidewalls between the first end and the second end, the first end having an opening and configured to attach to the firearm, the second end comprising a bottom plate, at least a first primary sidewall of the sidewalls comprising at least one vertical reinforcement groove each of which extending along a longitudinal direction of the magazine shell; and a magazine sidewall spring receivable in the magazine shell, the magazine sidewall spring having an outer surface contour corresponding to an inner surface contour of at least some of the sidewalls of the magazine shell, the magazine sidewall spring comprising at least one deformable groove each of which corresponding to a respective one of the at least one vertical reinforcement groove of the magazine shell, the magazine sidewall spring configured to provide a side support, by deforming, to one or more ammunition cartridges and exert a force on the one or more ammunition cartridges in directions generally perpendicular to the sidewalls of the magazine shell when the one or more ammunition cartridges are held in the magazine shell and in contact with the magazine sidewall spring.

2. The magazine of claim 1, wherein the first primary sidewall of the magazine shell also comprises a feeding lip extending with a curvature from the first primary sidewall at the first end of the magazine shell.

3. The magazine of claim 2, wherein one or more vertical reinforcement grooves of the at least one vertical reinforcement extend into the curvature of the feeding lip.

4. The magazine of claim 1, wherein a first vertical reinforcement groove of the at least one vertical reinforcement groove comprises first, second and third sections with the first section closer to the first end of the magazine shell than the second and third sections and with the second section disposed between the first and third sections, wherein a cross-sectional diameter of the first section of the first vertical reinforcement groove is different from a cross-sectional diameter of the third section of the first vertical reinforcement groove, and wherein a cross-sectional diameter of the second section of the first vertical reinforcement groove changes between the first section and the third section of the first vertical reinforcement groove.

5. The magazine of claim 4, wherein a second vertical reinforcement groove of the at least one vertical reinforcement groove comprises first, second and third sections with the first section closer to the first end of the magazine shell than the second and third sections and with the second section disposed between the first and third sections, wherein a cross-sectional diameter of the first section of the second vertical reinforcement groove is different from a cross-sectional diameter of the third section of the second vertical reinforcement groove, and wherein a cross-sectional diameter of the second section of the second vertical reinforcement groove changes between the first section and the third section of the second vertical reinforcement groove.

6. The magazine of claim 5, wherein the first vertical reinforcement groove is closer, than the second vertical reinforcement groove, to a sidewall of the magazine shell configured to face a rear end of each of one or more ammunition cartridges when the one or more ammunition cartridges are received in the magazine shell, and wherein the first section of the first vertical reinforcement groove is proportionally shallower than the first section of the second vertical reinforcement groove.

7. The magazine of claim 5, wherein the first primary sidewall of the magazine shell also comprises a feeding lip extending with a curvature from the first primary sidewall at the first end of the magazine shell, and wherein a radius of at least one of the first vertical reinforcement groove or the second vertical reinforcement groove gradually increases toward the feeding lip to have a flare-out shape such that a strength of the feeding lip is increased.

8. A magazine for a firearm, comprising:

a magazine shell configured to contain ammunition cartridges of different calibers therein, the magazine shell having a first end, a second end opposite the first end, and a plurality of sidewalls between the first end and the second end, the first end having an opening and configured to attach to the firearm, the second end comprising a bottom plate, at least a first primary sidewall of the sidewalls comprising a feeding lip and a deformable concave area located below the feeding lip, the concave area configured to deform in a manner such that:

the concave area caves inward with respect to the magazine shell when no ammunition cartridge is contained in the magazine shell or when no ammunition cartridge contained in the magazine shell is in contact with the concave area, the concave area bulges outward with respect to the magazine shell when one or more ammunition cartridges of a first caliber are contained in the magazine shell and in contact with the concave area, and the concave area caves inward with respect to the magazine shell and does not bulge outward when one or more ammunition cartridges of a second caliber smaller than the first caliber are contained in the magazine shell and in contact with the concave area.

9. The magazine of claim 8, wherein feeding lip extends with a curvature from the first primary sidewall at the first end of the magazine shell.

10. The magazine of claim 9, wherein one or more vertical reinforcement grooves of the at least one vertical reinforcement extend into the curvature of the feeding lip.

11. The magazine of claim 8, wherein a first vertical reinforcement groove of the at least one vertical reinforcement groove comprises first, second and third sections with the first section closer to the first end of the magazine shell than the second and third sections and with the second section disposed between the first and third sections, wherein a cross-sectional diameter of the first section of the first vertical reinforcement groove is different from a cross-sectional diameter of the third section of the first vertical reinforcement groove, and wherein a cross-sectional diameter of the second section of the first vertical reinforcement groove changes between the first section and the third section of the first vertical reinforcement groove.

12. The magazine of claim 11, wherein a second vertical reinforcement groove of the at least one vertical reinforcement groove comprises first, second and third sections with the first section closer to the first end of the magazine shell than the second and third sections and with the second section disposed between the first and third sections, wherein a cross-sectional diameter of the first section of the second vertical reinforcement groove is different from a cross-sectional diameter of the third section of the second vertical reinforcement groove, and wherein a cross-sectional diameter of the second section of the second vertical reinforcement groove changes between the first section and the third section of the second vertical reinforcement groove.

13. The magazine of claim 12, wherein the first vertical reinforcement groove is closer, than the second vertical reinforcement groove, to a sidewall of the magazine shell configured to face a rear end of each of one or more ammunition cartridges when the one or more ammunition cartridges are received in the magazine shell, and wherein the first section of the first vertical reinforcement groove is proportionally shallower than the first section of the second vertical reinforcement groove.

14. The magazine of claim 12, wherein the feeding lip extends with a curvature from the first primary sidewall at the first end of the magazine shell, and wherein a radius of at least one of the first vertical reinforcement groove or the second vertical reinforcement groove gradually increases toward the feeding lip to have a flare-out shape such that a strength of the feeding lip is increased.

15. The magazine of claim 8, wherein the first primary sidewall of the magazine shell further comprises a horizontal reinforcement groove extending along a latitudinal direction of the magazine shell that is perpendicular to the longitudinal direction of the magazine shell.

16. The magazine of claim 15, wherein the horizontal reinforcement groove is disposed in a proximity of and adjacent to an edge of the first primary sidewall at the first end of the magazine shell, and wherein the horizontal reinforcement groove intersects with one or more of the at least one vertical reinforcement groove.

* * * * *